US012782039B2

(12) United States Patent
Yun et al.

(10) Patent No.: US 12,782,039 B2
(45) Date of Patent: Nov. 3, 2026

(54) REFRIGERATOR AND MANUFACTURING METHOD THEREOF

(71) Applicant: LG ELECTRONICS INC., Seoul (KR)

(72) Inventors: Seongjun Yun, Seoul (KR); Chun Hee Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 269 days.

(21) Appl. No.: 18/235,967

(22) Filed: Aug. 21, 2023

(65) Prior Publication Data

US 2024/0068739 A1 Feb. 29, 2024

(30) Foreign Application Priority Data

Aug. 31, 2022 (KR) ..... 10-2022-0110248

(51) Int. Cl.
*F25D 23/06* (2006.01)
*F25D 23/08* (2006.01)

(52) U.S. Cl.
CPC ..... *F25D 23/066* (2013.01); *F25D 23/062* (2013.01); *F25D 23/087* (2013.01); *F25D 2323/021* (2013.01)

(58) Field of Classification Search
CPC .... F25D 23/066; F25D 23/069; F25D 23/087; F25D 2323/024; F25D 2400/04
See application file for complete search history.

(56) References Cited

U.S. PATENT DOCUMENTS

2005/0017618 A1* 1/2005 Myers ..... F25D 23/066 312/406
2008/0036349 A1 2/2008 Crompton et al.
2012/0313497 A1* 12/2012 Jang ..... F25D 23/069 312/401
2017/0176093 A1* 6/2017 Kang ..... F25D 23/066
2019/0078829 A1* 3/2019 Okazaki ..... F25D 23/066
2020/0284493 A1* 9/2020 Lee ..... F25D 11/02
2021/0041956 A1 2/2021 Hasburgh
2021/0356195 A1* 11/2021 Deka ..... F25D 21/04
2023/0079270 A1* 3/2023 Jung ..... F25D 23/069 312/407
2023/0130833 A1* 4/2023 Thomas ..... F25D 21/04 62/440
2023/0258391 A1* 8/2023 Park ..... F25D 23/063 220/592.09
2024/0318900 A1* 9/2024 Kang ..... F25D 23/066

FOREIGN PATENT DOCUMENTS

CN 111408189 A 7/2020
WO WO 2022/131721 A1 6/2022

* cited by examiner

*Primary Examiner* — Daniel J Rohrhoff
(74) *Attorney, Agent, or Firm* — Birch, Stewart, Kolasch & Birch, LLP

(57) ABSTRACT

A refrigerator includes a first inner case having a first front surface defining a first portion of an exterior of a front surface of the refrigerator, a second inner case having a second front surface defining a second portion of the exterior of the front surface of the refrigerator, the second inner case being separable from the first inner case, and a coupling assembly being disposed at a rear of each of the first front surface and the second front surface, the coupling assembly being configured to fix the first inner case to the second inner case. A method for manufacturing the refrigerator is also provided.

20 Claims, 35 Drawing Sheets

REFRIGERATOR AND MANUFACTURING METHOD THEREOF

CROSS-REFERENCE TO RELATED APPLICATION

This application claims priority to and the benefit of Korean Patent Application No. 10-2022-0110248, filed on Aug. 31, 2022, the disclosure of which is incorporated herein by reference in its entirety.

TECHNICAL FIELD

The present disclosure relates to a refrigerator and a manufacturing method of a refrigerator, and in particular, a large-sized refrigerator and a manufacturing method of a large-sized refrigerator that ensures improvement in assembly processing efficiency and an excellent front surface exterior design.

BACKGROUND

Refrigerators supply cold air, which is generated based on a circulation of refrigerants, to a storage compartment, and keep various types of storage targets fresh in the storage compartment for a long period of time.

In recent years, refrigerators having different structures have been developed to harmonize with an environment where refrigerators are disposed and with surrounding furniture or home appliances.

For example, refrigerators can be formed into built-in ones, and the built-in refrigerators can combine with furniture or home appliances and constitute a wall.

The cabinet main body a built-in refrigerator is accommodated together with a cabinet in a space that is already designed, and harmonizes with surrounding furniture or appliances. Accordingly, the entire design of the refrigerator depends on the exterior of the front surface of the refrigerator.

In the case of a built-in refrigerator, an excellent front surface exterior design is required.

Additionally, the cabinet of the refrigerator can be formed in a way that an inner case is coupled to an outer case forming the outer surface of the inner case.

At this time, the inner case can be formed based on various forming methods, and for example, can be formed integrally based on vacuum forming.

The vacuum forming method may be performed as follows.

A resin sheet for forming is heated to be readily deformed, and then placed in a vacuum case one side of which is open.

The inside of the vacuum case is vacuumed, and a portion of the heated resin sheet is drawn into the vacuum case.

At this time, since the edge portion of the resin sheet is fixed to the outside of the vacuum case, the central portion of the resin sheet is swollen and suctioned into the vacuum case such that the resin sheet is formed primarily.

Then a mold having a shape corresponding to the shape of an inner case to be created is placed near the primarily formed resin sheet, and high-pressure air is blown into the vacuum case to contact the resin sheet with the mold, such that the resin sheet is formed secondarily.

Additionally, after the resin contact closely contacting the mold cools, a molded material is detached from the mold, and while an unnecessary portion is removed from the molded material of the inner case, the inner case can be vacuum formed in a process of forming a groove and the like for an assembly.

However, in the case where the entire inner case is integrally formed for a large-sized refrigerator, for example, in the case where a large-sized inner case in which a refrigerator compartment and a freezer compartment are divided in the up-down direction is integrally formed, a new vacuum forming facility such as a bigger mold is required, leading to investment in an additional facility.

Further, since the temperature of the storage compartments of the refrigerator remains low, dew can be formed in the refrigerator.

Dew formation means that vapor in the air is condensed on the surface of the cabinet of the refrigerator or the surface of the door of the refrigerator, as the temperature of the storage compartments of the refrigerator drops to a dew point or less.

To prevent the dew formation of the refrigerator, the temperature of the surfaces on which dew is formed needs to be maintained at the dew point or greater.

In this context, a hot line can be disposed at the cabinet of the refrigerator.

The hot line forms a flow path of refrigerants, and refrigerants passing through the hot line supply heat to the surface of the cabinet of the refrigerator to maintain the temperature of the surface of the cabinet of the refrigerator at the dew point or greater.

In the case where the inner case is divided into a refrigerator compartment and a freezer compartment, the hot line can be disposed on the front surface of the inner case in a way that the hot line is divided into a hot line for a refrigerator compartment and a hot line for a freezer compartment.

At this time, the positions of the hot line for a refrigerator compartment and the hot line for a freezer compartment, divided separately, need to be adjusted and arranged such that the hot lines are fixed to the integrally formed inner case at the same time, causing difficulty in disposing the hot lines and deterioration in processing efficiency.

Furthermore, since the hot lines are disposed on the front surface of the inner case, an additional cover member covering the hot lines needs to be disposed additionally on the front surface of the inner case.

SUMMARY

Technical Problems

The objective of the present disclosure is to provide a refrigerator and a manufacturing method of a refrigerator that makes it possible to manufacture a large-sized refrigerator without an additional forming facility.

The objective of the present disclosure is to provide a refrigerator and a manufacturing method of a refrigerator that has an excellent front surface exterior.

The objective of the present disclosure is to provide a refrigerator and a manufacturing method of a refrigerator that makes it possible to couple a plurality of inner cases separating from each other, in a simplified assembly structure.

The objective of the present disclosure is to provide a refrigerator and a manufacturing method of a refrigerator that makes it possible to ensure improvement in processing efficiency at a time of coupling a plurality of inner cases that separates from each other.

The objective of the present disclosure is to provide a refrigerator and a manufacturing method of a refrigerator that makes it possible to ensure improvement in processing efficiency at a time of disposing a plurality of hot lines, which is independent from each other, in an inner case.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solutions

For a refrigerator in one aspect, a coupling assembly may be disposed at rears of a first front surface of a first inner case and a second front surface of a second inner case.

Specifically, since the coupling assembly fixing the first inner case and the second inner case is disposed at the rears of the first front surface of the first inner case and the second front surface of the second inner case which are separable from each other, a large-sized refrigerator may be manufactured without an additional forming facility, and an assembly line of the front surfaces of the inner cases, as a main exterior factor, may be reduced.

For a refrigerator in one aspect, a coupling assembly may be disposed on rear surfaces of a first protrusion of a first inner case and a second protrusion of a second inner case.

Specifically, since the coupling assembly fixing the first inner case and the second inner case is disposed on the rear surfaces of the first protrusion of the first inner case and the second protrusion of the second inner case which are separable from each other, a large-sized refrigerator may be manufactured without an additional forming facility, and an assembly line of the front surfaces of the inner cases, as a main exterior factor, may be reduced.

The refrigerator comprises a first inner case comprising a first protrusion that protrudes in one outward direction, a second inner case comprising a second protrusion that protrudes in one outward direction to face the first protrusion and being separable from the first inner case, and a coupling assembly being coupled to rear surfaces of the first protrusion and the second protrusion and fixing the first inner case and the second inner case.

In another aspect, each of the first inner case and the second inner case may be an integrated one.

In another aspect, the first protrusion may extend along a left-right direction of a front-end portion of the first inner case and protrude toward a lower portion of the first inner case, and the second protrusion may extend along a left-right direction of a front-end portion of the second inner case and protrude toward an upper portion of the second inner case.

In another aspect, the first inner case may comprise a first storage compartment forming one or more storage spaces and a first front surface being disposed to protrude outward along an edge portion of a front surface of the first storage compartment, the first protrusion may protrude downward from the first front surface, the second inner case may comprise a second storage compartment forming one or more storage spaces and a second front surface being disposed to protrude outward along an edge portion of a front surface of the second storage compartment, and the second protrusion may protrude upward from the second front surface.

In another aspect, the first front surface and the second front surface may form an exterior of a front surface of the refrigerator.

In another aspect, a first hot line may be disposed along a back of the first front surface, and a second hot line may be disposed along a back of the second front surface.

In another aspect, the coupling assembly may comprise a first coupling plate being coupled to the rear surface of the first protrusion, and a second coupling plate being coupled to the rear surface of the second protrusion, the first hot line may be disposed between the first front surface and the first coupling plate, and the second hot line may be disposed between the second front surface and the second coupling plate.

In another aspect, the coupling assembly may comprise a first coupling plate being coupled to the rear surface of the first protrusion and a second coupling plate being coupled to the rear surface of the second protrusion, and the first coupling plate and the second coupling plate may be coupled in a mutually combined structure.

In another aspect, the first coupling plate may comprise a first combination surface facing the second coupling plate, the second coupling plate may comprise a second combination surface facing the first coupling plate, and a gasket foam may be disposed between the first combination surface and the second combination surface.

In another aspect, the refrigerator may further comprise a pair of first doors that open and close the first inner case by using a hinge, and the first coupling plate may comprise a pair of hinge mounting parts into which the hinge is inserted, at both sides thereof.

In another aspect, a hinge cover covering the hinge mounting part may be disposed on a front surface of the hinge mounting part, and the hinge cover may form the exterior of the front surface of the refrigerator.

In another aspect, the refrigerator may further comprise aback plate that is coupled to rear surfaces of the first coupling plate and the second coupling plate, in a structure where the back plate combines with the first coupling plate and the second coupling plate.

In another aspect, the back plate may comprise a body part, a first extension part extending from one side of the body part and inclining outward and downward, and a second extension part extending from the other side of the body part and inclining outward and downward, each of the first coupling plate and the second coupling plate may comprise a first reinforcement rib with a first inclination part that has a shape corresponding to a shape of the first extension part, and a second reinforcement rib with a second inclination part that has a shape corresponding to a shape of the second extension part, on the rear surface thereof, and in a case where the back plate is coupled to the first coupling plate and the second coupling plate, the first extension part and the second extension part may press the first inclination part and the second inclination part respectively.

In another aspect, the body part may comprise a plurality of fastening holes, each of the first coupling plate and the second coupling plate may comprise a plurality of first rear surface fastening parts and a plurality of second rear surface fastening parts that correspond to the fastening holes, on the rear surface thereof, the fastening hole may be fastened to the first rear surface fastening part and the second rear surface fastening part by a fastening member, and the body part may press the first rear surface fastening part and the second rear surface fastening part.

In another aspect, a deco plate may be disposed on front surfaces of the first protrusion and the second protrusion and may be coupled to the first protrusion and the second protrusion in a way that covers the first protrusion and the second protrusion.

In another aspect, the deco plate may form the exterior of the front surface of the refrigerator.

For the refrigerator in one aspect, a coupling assembly is disposed on rear surfaces of a first inner case and a second inner case.

Specifically, a coupling assembly fixing the first inner case and the second inner case may be disposed on the rear surfaces of the first inner case and the second inner case being separable from each other, thereby manufacturing a large-sized refrigerator without an additional forming facility and reducing an assembly line of the front surfaces of the inner cases as a main exterior factor.

The refrigerator comprises a first inner case, a second inner case being separable from the first inner case, and a coupling assembly being coupled to rear surfaces of the first inner case and the second inner case and fixing the first inner case and the second inner case.

In another aspect, the first inner case may comprise a first protrusion protruding downward from a front of the first inner case, the second inner case may comprise a second protrusion protruding upward from a front of the second inner case, and the coupling assembly may be coupled to the rear surfaces of the first protrusion and the second protrusion.

In one aspect, a manufacturing method of a refrigerator comprises separately forming a first inner case and a second inner case, coupling a first coupling plate and a second coupling plate respectively to rear surfaces of the first inner case and the second inner case, and coupling a back plate to rear surfaces of the first coupling plate and the second coupling plate.

Specifically, the rear surfaces of the first inner case and the second inner case separated from each other are coupled by the first coupling plate and the second coupling plate and additionally by the back plate. Accordingly, the first inner case and the second inner case are temporarily assembled, based on the coupling on the rear surface of the refrigerator, with no need to fix the first inner case and the second inner case on the front surface of the refrigerator, ensuring improvement in processing efficiency.

The manufacturing method of a refrigerator comprises separately forming a first inner case that comprises a first protrusion protruding downward from a front of the first inner case, and a second inner case that comprises a second protrusion protruding upward from a front of the second inner case, coupling a first coupling plate and a second coupling plate respectively to rear surfaces of the first protrusion and the second protrusion, disposing the first inner case and the second inner case in a way that the first coupling plate and the second coupling plate face each other, coupling a back plate to rear surfaces of the first coupling plate and the second coupling plate, assembling an outer case in a way that outer surfaces of the first inner case and the second inner case are surrounded except for front surfaces of the first inner case and the second inner case, injecting a foaming liquid into the outer case, and coupling a deco plate to front surfaces of the first protrusion and the second protrusion.

In another aspect, the manufacturing method may comprise disposing a first hot line and a second hot line respectively along a rear surface of the first inner case and a rear surface of the second inner case, before coupling a first coupling plate and a second coupling plate respectively to rear surfaces of the first protrusion and the second protrusion.

Advantageous Effects

In the refrigerator of the present disclosure, since the first inner case and the second inner case may be formed in a way that the first inner case and the second inner case are separable from each other, and then coupled to the coupling assembly, a large-sized refrigerator may be manufactured without an additional forming facility.

In the refrigerator of the present disclosure, since the coupling assembly is disposed on the rear surfaces of the first protrusion of the first inner case and the second protrusion of the second inner case, the first inner case and the second inner case may be coupled, reducing an assembly line of the front surfaces of the inner cases as a main exterior factor and ensuring an excellent front surface exterior design.

In the refrigerator of the present disclosure, since the first front surface of the first inner case and the second front surface of the second inner case form the exterior of the front surface of the refrigerator, an additional exterior formation member may not be needed, reducing the number of components and ensuring improvement in processing efficiency.

In the refrigerator of the present disclosure, since the first front surface of the first inner case, and the second front surface of the second inner case, and the deco plate covering the front surfaces of the first protrusion and the second protrusions form the exterior of the front surface of the refrigerator, the boundary line of each component, which is visible from the front surface of the refrigerator, may be hidden at a maximum level, ensuring an excellent front surface exterior design.

In the manufacturing method of a refrigerator of the present disclosure, the rear surfaces of the first inner case and the second inner case separated from each other may be coupled by the first coupling plate and the second coupling plate and additionally by the back plate. Accordingly, the first inner case and the second inner case may be temporarily assembled, based on the coupling on the rear surface of the refrigerator, with no need to fix the first inner case and the second inner case on the front surface of the refrigerator, ensuring improvement in processing efficiency.

In the manufacturing method of a refrigerator of the present disclosure, the first inner case and the second inner case 200 separated from each other may be coupled to the first coupling plate and the second coupling plate that mutually combine on their rear surfaces, and additionally coupled to the back plate having a structure in which the back plate combines with the first coupling plate and the second coupling plate, and when the worker couples each component, the combined structure may guide a coupling between the first inner case and the second inner case, enabling the coupling without a precise coupling process and ensuring improvement in processing efficiency.

In the manufacturing method of a refrigerator of the present disclosure, the first hot line and the second hot line may be disposed respectively along the rear surface of the first inner case and the rear surface of the second inner case, and then the first coupling plate and the second coupling plate may be disposed respectively on the rear surfaces of the first protrusion and the second protrusion, to couple the first inner case and the second inner case, causing no need to dispose and fix each of the hot lines at the same time and ensuring improvement in processing efficiency.

Specific effects are described along with the above-described effects in the section of detailed description.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
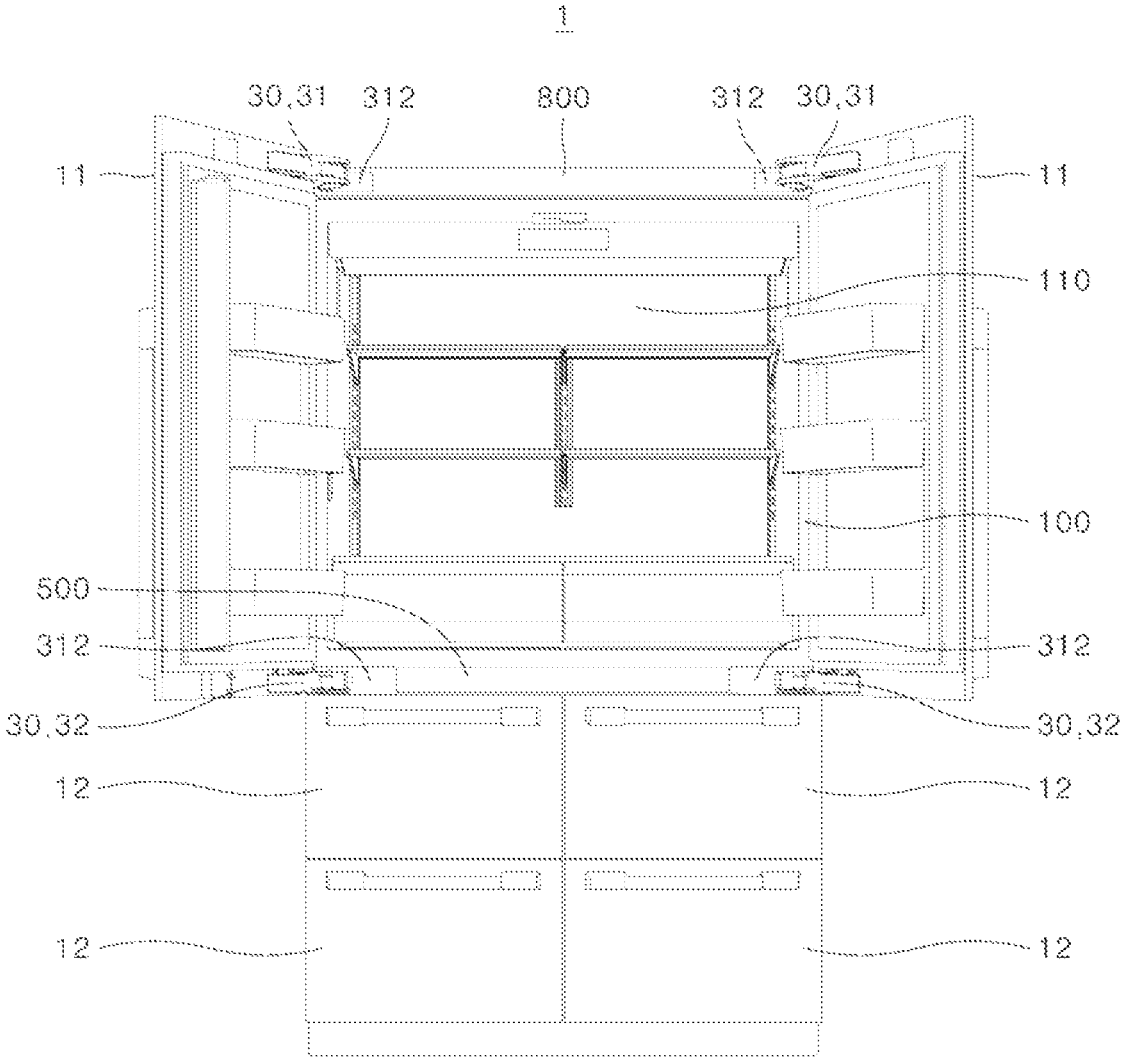
FIG. 1 is a front view showing a refrigerator with a first door open.
Figure 2:
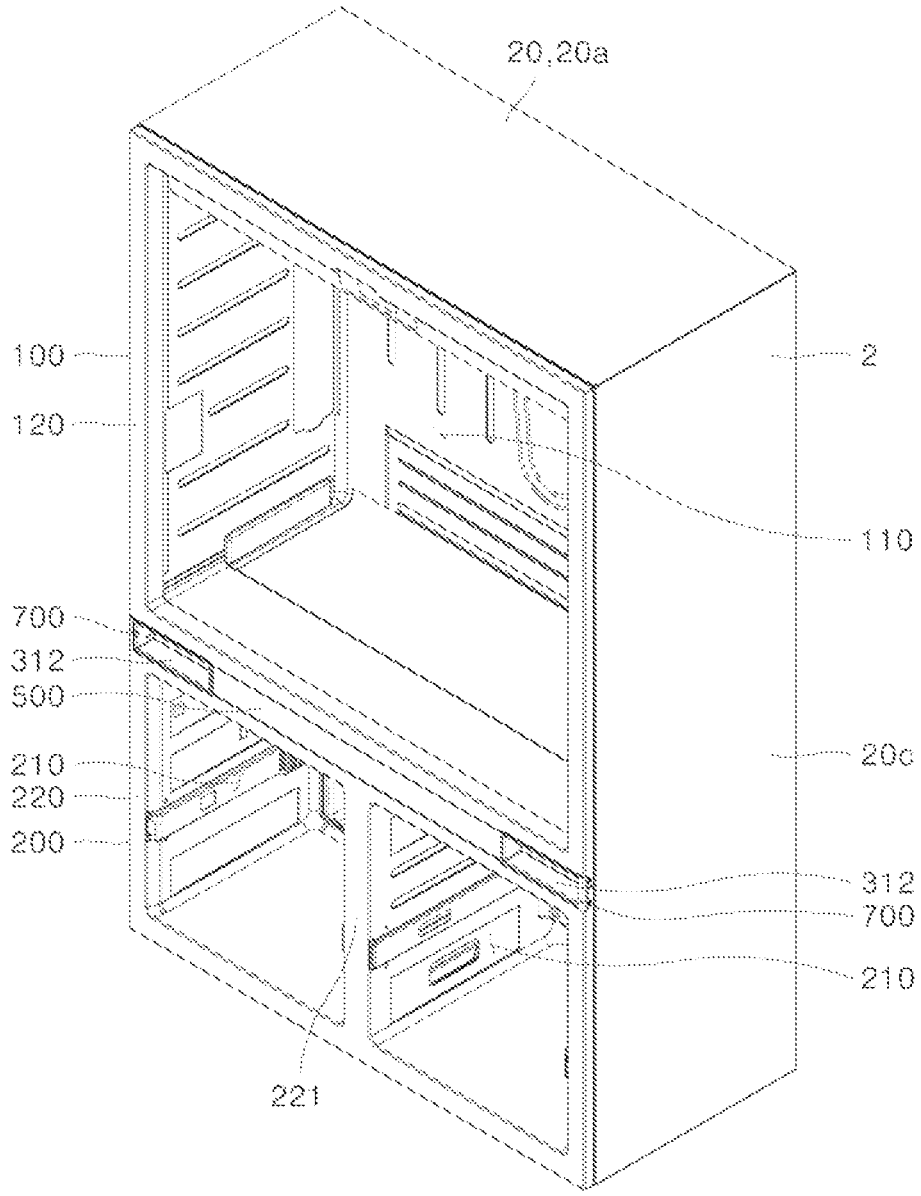
FIG. 2 is a front perspective view showing a refrigerator with a first door and a second door removed.
Figure 3:
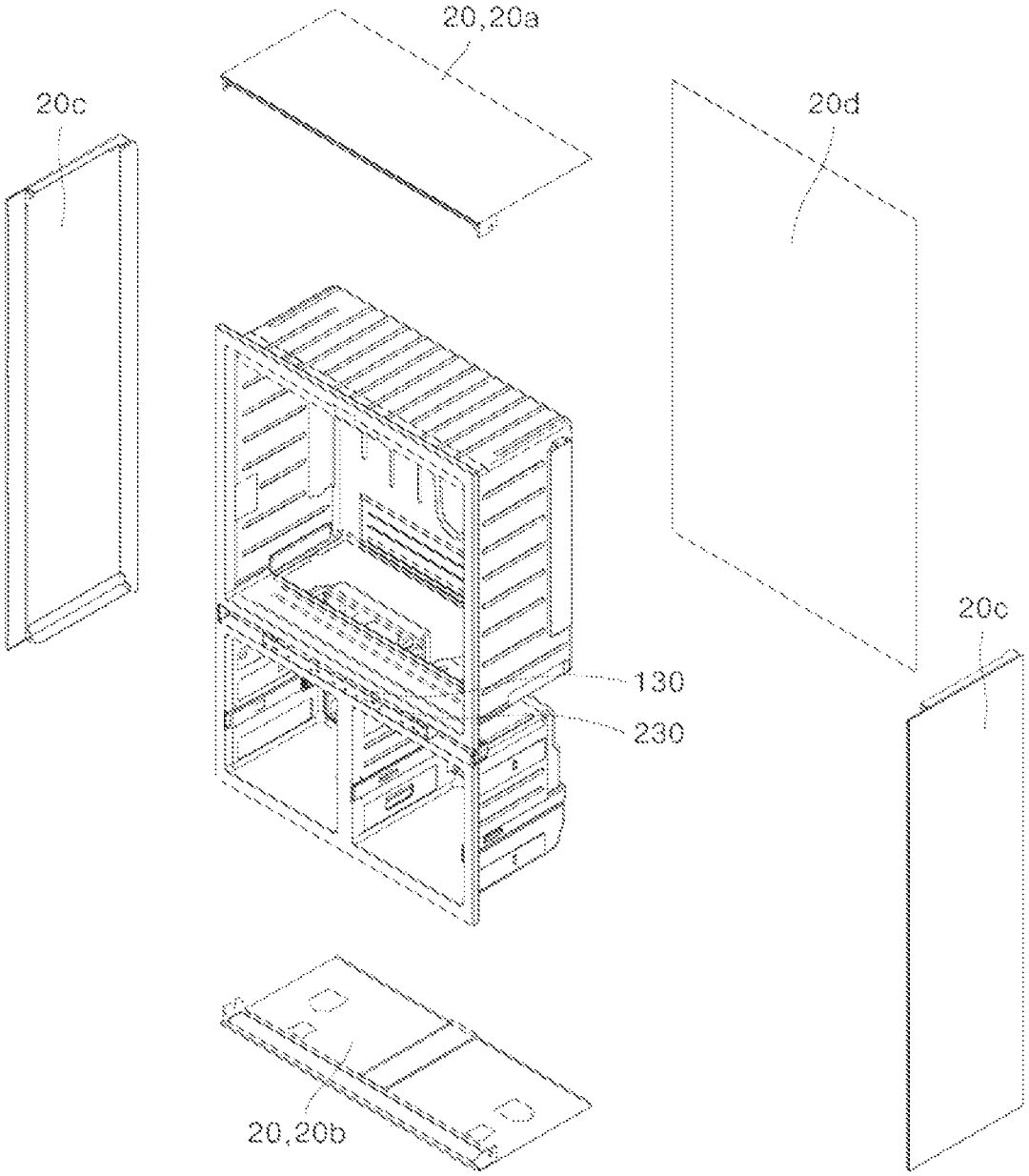
FIG. 3 is an exploded perspective view showing a refrigerator with a first door and a second door removed.
Figure 4:
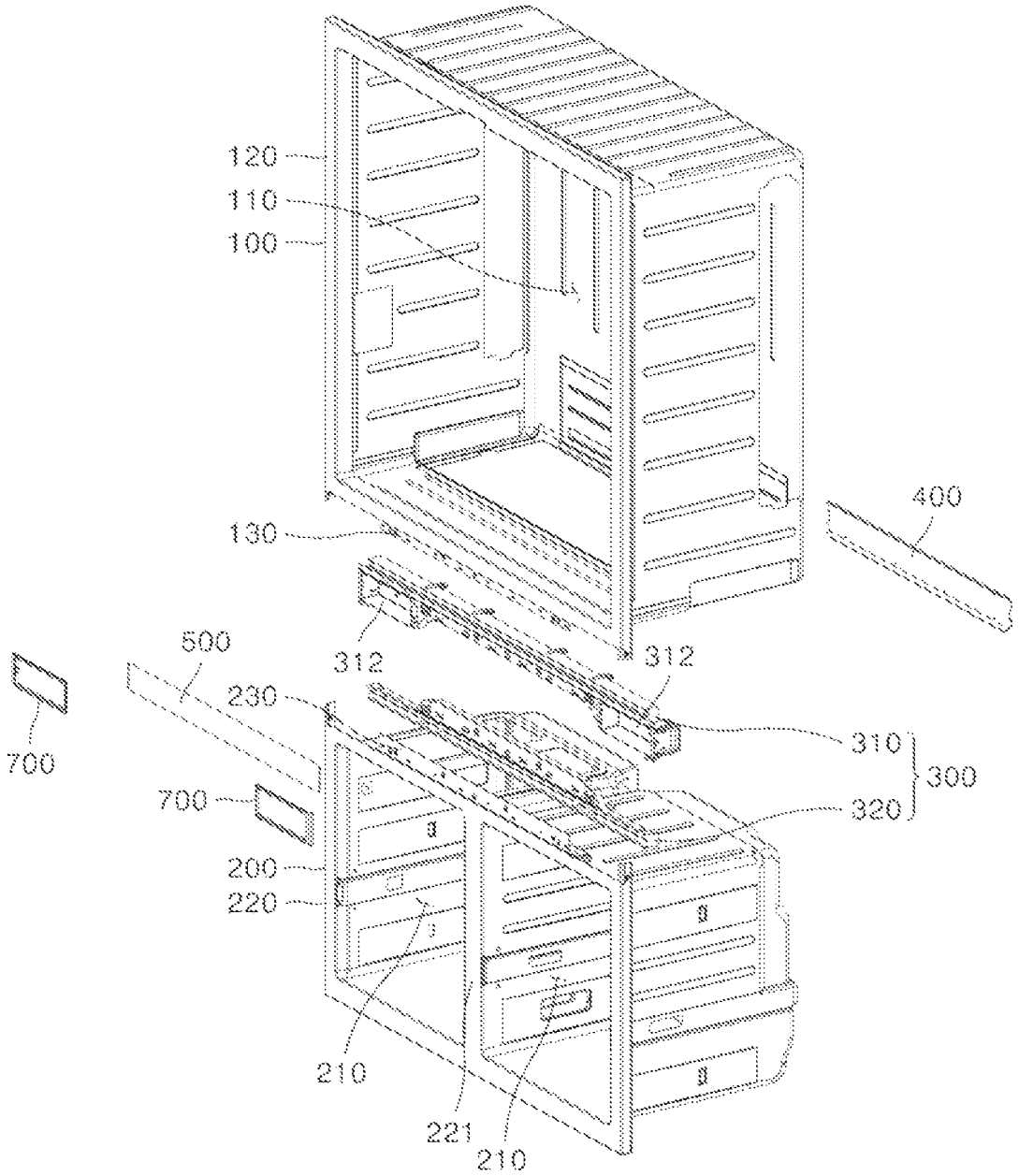
FIG. 4 is an exploded perspective view showing a first inner case, a second inner case, a first coupling plate, a second coupling plate, a deco plate, and a back plate.
Figure 5:
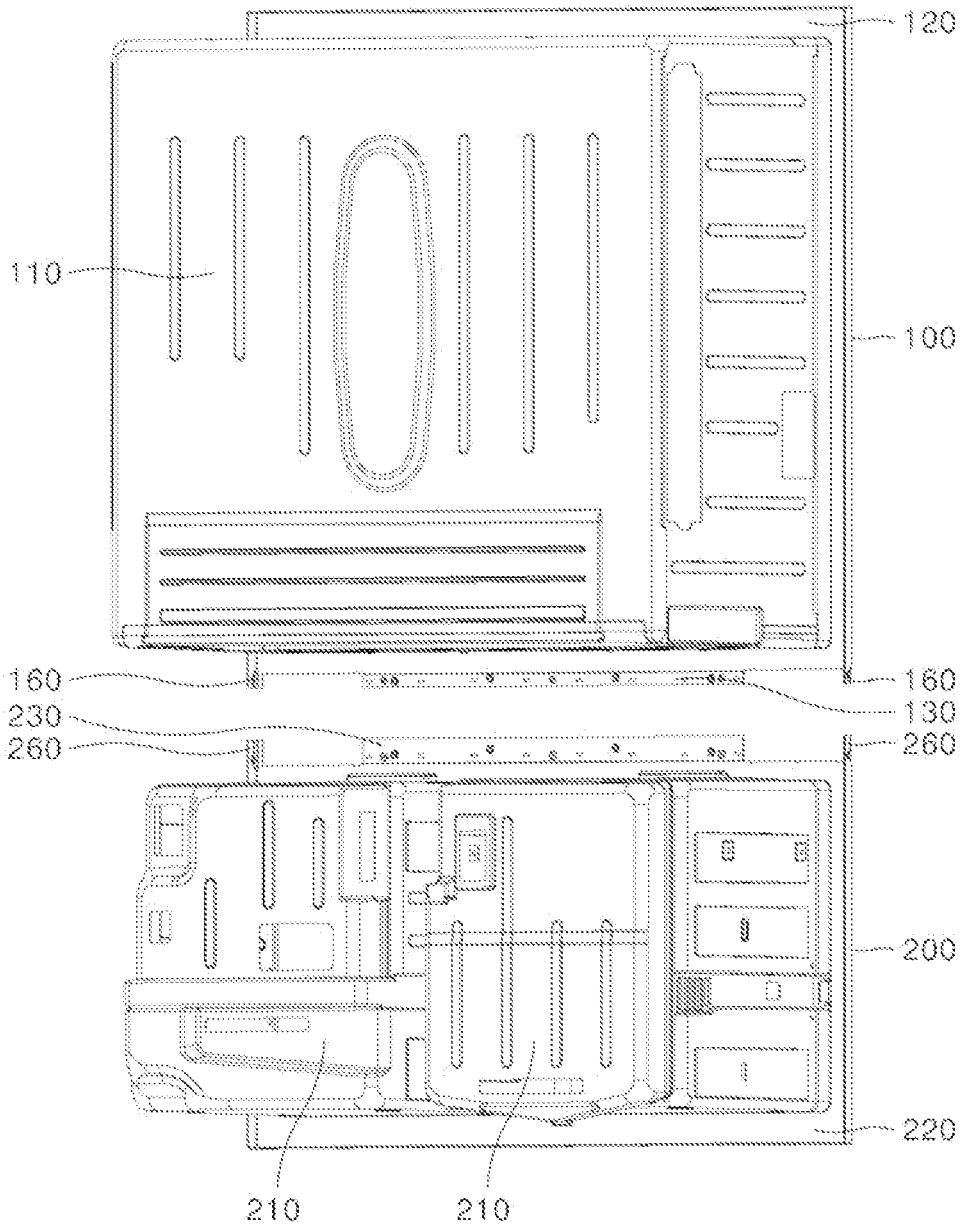
FIG. 5 is a rear perspective view showing that a first inner case and a second inner case separate from each other.
Figure 6:
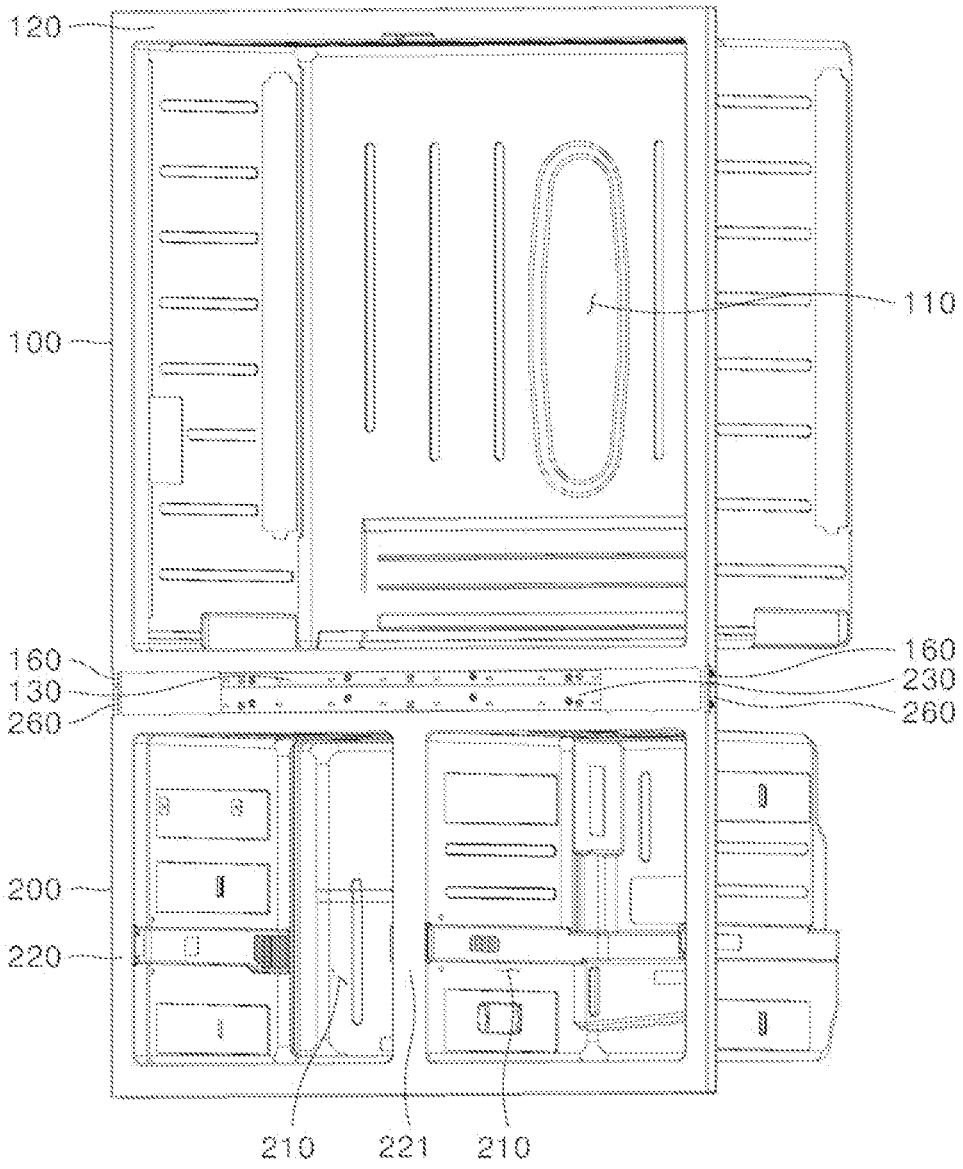
FIG. 6 is a front perspective view showing that a first inner case and a second inner case are coupled.
Figure 7:
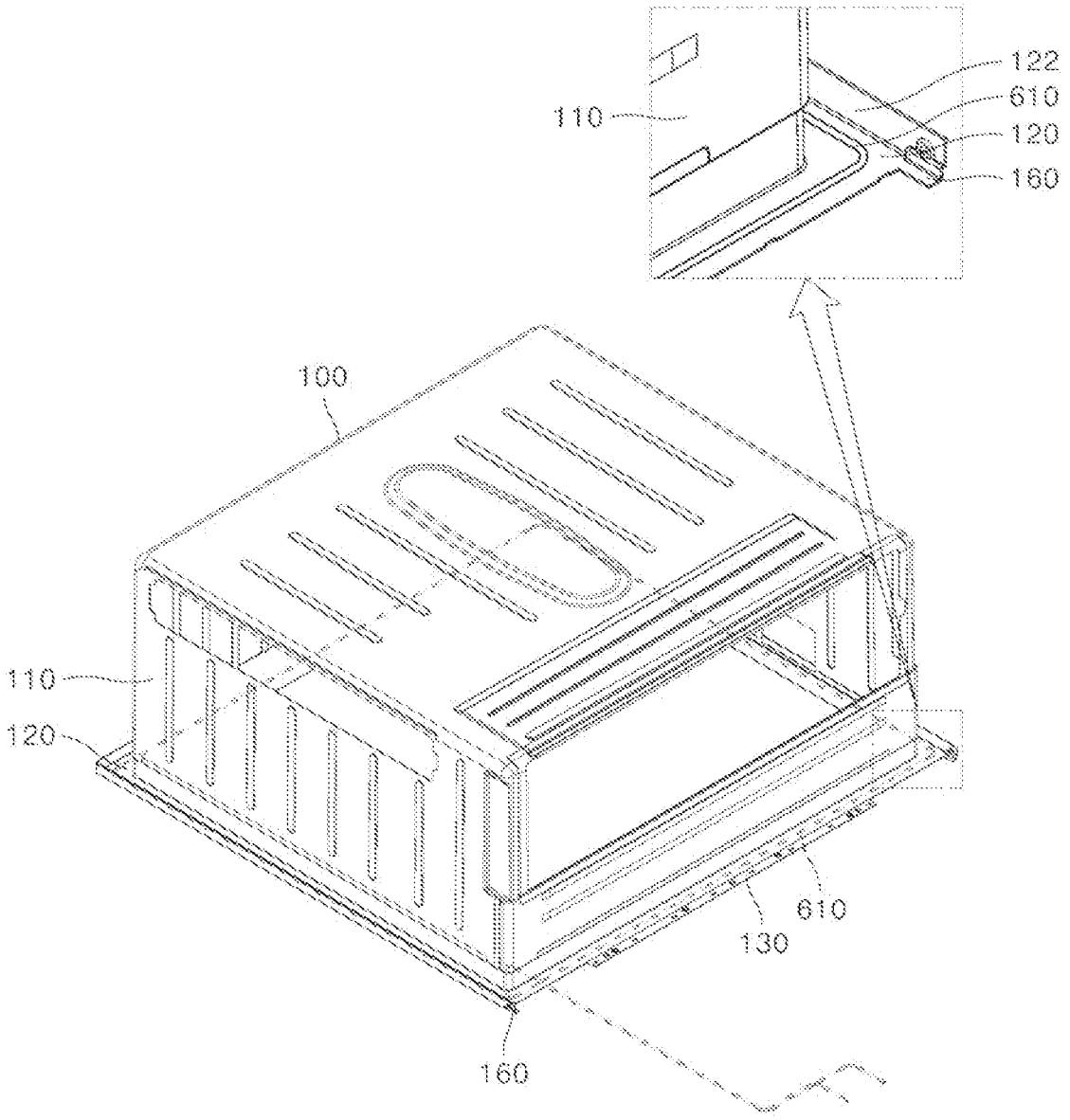
FIG. 7 is a view showing that a first hot line is disposed along the rear surface of a first inner case.
Figure 8:
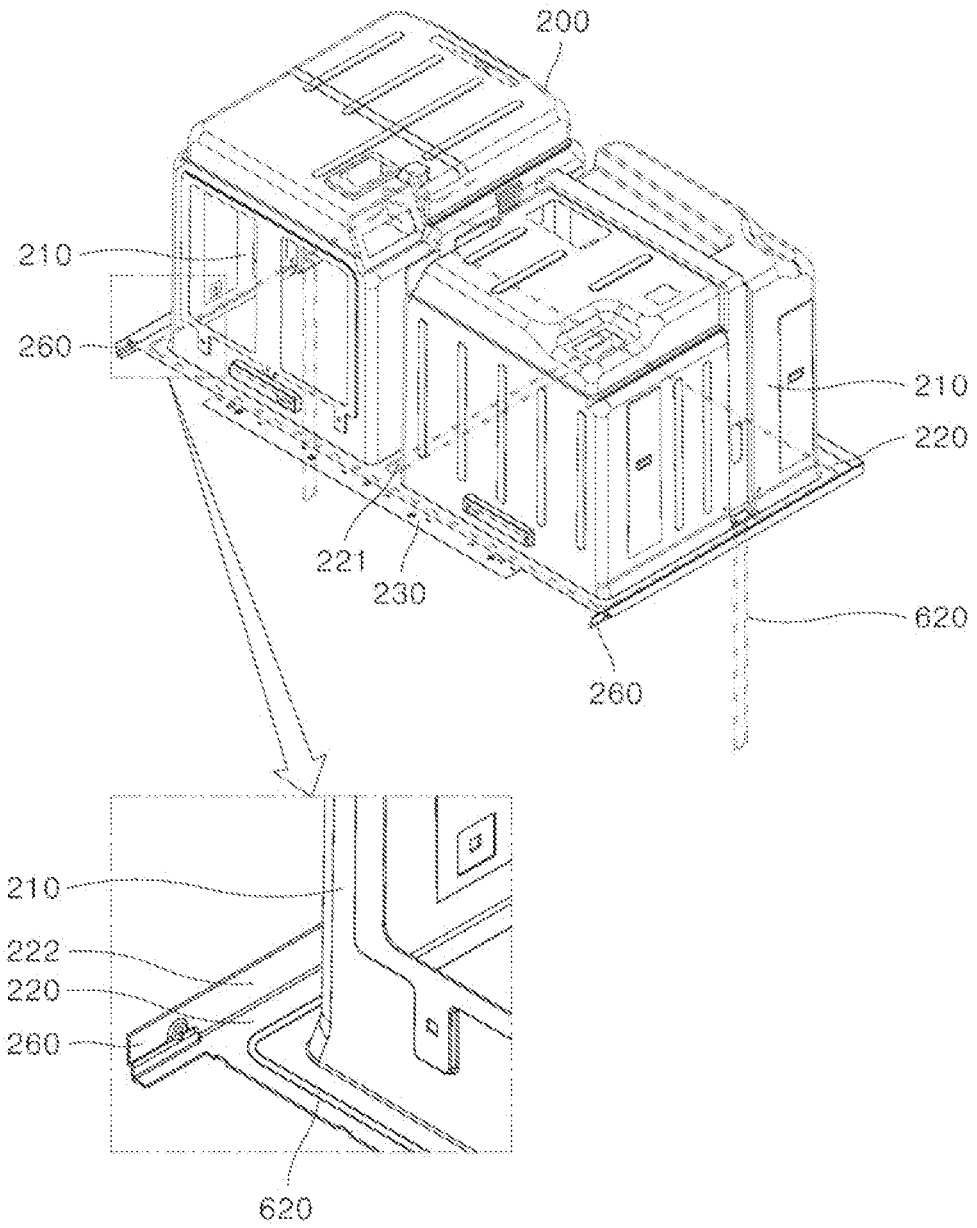
FIG. 8 is a view showing that a second hot line is disposed along the rear surface of a second inner case.

The above-described aspects, features and advantages are specifically described hereafter with reference to accompanying drawings such that one having ordinary skill in the art to which the subject matter of the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar component.

The terms "first", "second" and the like are used herein only to distinguish one component from another component. Thus, the components are not to be limited by the terms. Certainly, a first component can be a second component, unless stated to the contrary.

Throughout the disclosure, each component can be provided a single one or a plurality of ones, unless stated to the contrary.

When any one component is described as being "in the upper portion (or the lower portion)" or "on (or under)" another component, any one component can be directly on (or under) another component, and an additional component can be interposed between the two components.

When any one component is described as being "connected", "coupled" or "connected" to another component, any one component can be directly connected or coupled to another component, but an additional component can be "interposed" between the two components or the two components can be "connected", "coupled" or "connected" by an additional component.

In the disclosure, singular forms include plural forms as well, unless explicitly indicated otherwise. In the disclosure, the terms "comprise", "being comprised of" and the like do not imply necessarily including stated components or stated steps and imply excluding some of the stated components or stated steps or further including additional components or additional steps.

In the disclosure, singular forms include plural forms as well, unless explicitly indicated otherwise. In the disclosure, the terms "comprise", "being comprised of" and the like do not imply necessarily including stated components or stated steps and imply excluding some of the stated components or stated steps or further including additional components or additional steps.

Throughout the disclosure, the terms "A and/or B" as used herein can denote A, B or A and B, and the terms "C to D" can denote C or greater and D or less, unless stated to the contrary.

Hereafter, a refrigerator and a manufacturing method thereof are described in several embodiments.

With reference to FIGS. 1 to 8, a refrigerator 1 in one embodiment and main components constituting the refrigerator 1 are described respectively.

The exterior of the refrigerator 1 may be formed by a cabinet 2 comprising one or more storage compartments 110, 210 as a storage space of products therein, and a plurality of doors 11, 12 opening and closing an open front surface of the cabinet 2.

The cabinet 2 may comprise an outer case 20 and an inner case 10 being coupled to the inside of the outer case 20.

The cabinet 2 may be shaped into a box, the front surface of which is open, and divided into one or more storage spaces and comprise a refrigerator compartment and/or a freezer compartment.

For the inner case 10, a first inner case 100 may be disposed in the upper portion of the inner case 10, and a second inner case 200 may be disposed in the lower portion of the inner case 10.

At this time, the first inner case 100 may comprise one or more first storage compartments 110, and the first storage compartment 110 may be a refrigerator compartment. The second inner case 200 may comprise one or more second storage compartments 210, and the second storage compartment 210 may be a freezer compartment.

However, the first storage compartment 110 and the second storage compartment 210 are not limited as described above. The first storage compartment 110 may be a refrigerator compartment, the second storage compartment 210 may be a freezer compartment, and each of the first storage compartment 110 and the second storage compartment 210 may be a variable storage compartment such that the freezer compartment and the refrigerator compartment are changeable.

For example, the first inner case 100 may comprise one first storage compartment 110, but not be limited.

Additionally, the space of the second inner case 200 may be divided by a division part 221, near the central area of the second inner case 200, in an up-down direction, such that a plurality of second storage compartments 210 is disposed side by side, but not limited.

Further, the plurality of second storage compartments 210 may comprise a barrier part (not illustrated) that divides the space of each second storage compartment 210, near the central area of the second storage compartment, in a left-right direction, such that each second storage compartment 210 is divided into a plurality of spaces again, but not be limited.

The first storage compartment 110 of the first inner case 100 may be opened and closed by a pair of rotary first doors 11 that is rotated by a hinge 30.

A pair of upper hinges 31 coupled to portions at the upper side of the first door 11 may be respectively mounted in a pair of hinge mounting parts 312 that is formed on surfaces at both sides of a finish plate 800 disposed in the upper portion of the first storage compartment 110, and may provide a rotation axis of the portions at the upper side of the first door 11.

Additionally, a pair of lower hinges 32 coupled to portions at the lower side of the first door 11 may be respectively mounted in the lower portion of the first storage compartment 110, i.e., a pair of hinge mounting parts 312 that is formed on surfaces at both sides of the deco plate 500 disposed between the first storage compartment 110 and the second storage compartment 210, and may provide a rotation axis of the portions at the lower side of the first door 11.

The second storage compartment 210 of the second inner case 200 may be opened and closed by a plurality of drawer-type second doors 12 that is inserted and drawn by a rail.

In the present disclosure, four second doors 12 are provided to open and close four second storage compartments 210 that are divided by the division part 221 and the barriers (not illustrated), but not limited.

The rear surface, lateral surfaces, upper surface and lower surface of the outer case 20 may be respectively shaped into an individual assembly body.

The rear surface 20*d* of the outer case may be disposed on the rear surfaces of the first inner case 100 and the second inner case 200, the lateral surfaces 20*c* of the outer case may be disposed on both lateral surfaces of the first inner case 100 and the second inner case 200, and the upper surface 20*a* of the outer case and the lower surface 20*b* of the outer case may be respectively disposed on the upper surfaces and the lower surfaces of the first inner case 100 and the second inner case 200, such that the outer case 20 may form the outer surface of the refrigerator 1 except for the front surface of the refrigerator 1.

The first inner case 100 and the second inner case 200 may be disposed to be inserted into the outer case 20, and the front surfaces of the first inner case 100 and the second inner case 200 may be exposed outward to form the outer surface of the front surface of the refrigerator 1.

The first inner case 100 and the second inner case 200 may be formed in a way that the first inner case 100 and the second inner case 200 can be divided and separated from each other.

For example, each of the first inner case 100 and the second inner case 200 may be formed as an integrated one (i.e., one-piece member), based on vacuum forming.

The first inner case 100 may comprise a first storage compartment 110 forming one or more storage spaces, and a first front surface 120 being disposed to protrude outward along the edge portion of the front surface of the first storage compartment 110 at the front thereof.

Since the outer diameter of the first front surface 120 is greater than the inner diameter of the first storage compartment 110, the first front surface 120 may protrude in the form of a thin plate along the edge portion of the outside of the first storage compartment 110.

The first inner case 100 may comprise a first protrusion 130 protruding in one outward direction.

For example, the first protrusion 130 may be formed to protrude in a downward direction, from the first front surface 120.

Herein, the downward direction denotes a direction toward the second inner case 200.

The first protrusion 130 may be formed in a way that the first protrusion 130 extends in the form of a bar that is long in a left-right direction of the front-end portion of the first front surface 120 disposed in the lower portion of the first inner case 100 and protrudes downward.

The first protrusion 130 may be formed to have a predetermined distance from both ends of the front-end portion of the first front surface 120 disposed in the lower portion of the first inner case 100 while extending in the left-right direction, with respect to the center of the first inner case 100.

A pair of first side extension parts 160 may be provided at both ends of the front-end portion of the first front surface 120 in the lower portion of the first inner case 100, where the first protrusion 130 is disposed, and may extend and protrude downward at a length that is substantially the same as that of the first protrusion 130.

A separation space between the first protrusion 130 and each of the first side extension parts 160 may form the upper area of a space in which the lower hinge 32 is mounted.

The first protrusion 130 and the first side extension part 160 may be formed to have a thickness less than that of the first front surface 120.

When viewed from a lateral surface of the first inner case 100, the first front surface 120 may protrude further and have a greater thickness than the first protrusion 130 and the first side extension part 160, to form a step.

The second inner case 200 may comprise a second storage compartment 210 forming one or more storage spaces, and a second front surface 220 being disposed to protrude outward along the edge portion of the front surface of the second storage compartment 210 at the front thereof.

As described above, the space of the second inner case 200 may be divided by a division part 221, in the central area of the second inner case 200, in the up-down direction, into a plurality of second storage compartments 210.

At this time, the front surface of the division part 221, and the front surface of the second front surface 220 may be formed on the same planar surface, and when the user sees the division part 221 and the second front surface 220 from the front surface of the refrigerator, the division part 221 and the second front surface 220 may be formed integrally, such that the user does not recognize a boundary area between the division part 221 and the second front surface 220.

The outer diameter of the second front surface 220 is greater than the inner diameter of the plurality of second storage compartments 210. Accordingly, the second front surface 220 may be formed to protrude in the form of a thin plate along the edge portion of the outside of the second storage compartment 210.

The second inner case 200 may comprise a second protrusion 230 protruding in one outward direction.

For example, the second protrusion 230 may protrude in an upward direction from the second front surface 220.

Herein, the upward direction denotes a direction toward the first inner case 100.

The second protrusion 230 may be formed in a way that the first protrusion 130 extends in the form of a bar that is long in a left-right direction of the front-end portion of the second front surface 220 disposed in the upper portion of the second inner case 200 and protrudes upward.

The second protrusion 230 may be formed to have a predetermined distance from both ends of the front-end portion of the second front surface 220 disposed in the upper portion of the second inner case 200, while extending in the left-right direction, with respect to the center of the second inner case 200.

A pair of second side extension parts 260 may be provided at both ends of the front end portion of the second front surface 220 disposed in the upper portion of the second inner case 200, where the second protrusion 230 is disposed, and may extend and protrude upward at a length that is substantially the same as that of the second protrusion 230.

A separation space formed between the second protrusion 230 and each of the second side extension parts 260 may form the lower area of a space in which the lower hinge 32 is mounted.

The second protrusion 230 and the second side extension part 260 may be formed to have a thickness less than that of the second front surface 220.

When viewed from a lateral surface of the second inner case 200, the second front surface 220 may protrude further and have a greater thickness than the second protrusion 230 and the second side extension part 260, to form a step.

Each of the first inner case 100 and the second inner case 200 may be disposed such that the first protrusion 130 and the second protrusion 230 face each other, and a coupling assembly 300 may be coupled to the rear surface of the first protrusion 130 and the rear surface of the second protrusion 230 to fix the first inner case 100 and the second inner case 200.

In the present disclosure, the coupling assembly 300 has a structure in which a first coupling plate 310 and a second coupling plate 320 separate, for example, but not be limited. The coupling assembly 300 may be an integrated one that is shaped into one body, instead of a separate one.

In the case where the coupling assembly 300 is an integrated one shaped into one body, a first inner case side of the body may be coupled to one side of the first inner case 100 by a coupling member, and a second inner case side of the body may be coupled to one side of the second inner case 200 by a coupling member.

As described above, for the refrigerator 1 of the present disclosure, the first inner case 100 and the second inner case 200 are formed respectively in a way that the first inner case 100 and the second inner case 200 separate from each other, and then coupled by the coupling assembly 300, making it possible to provide an inner case of a size desired by the user based on an assembly without limitations to a forming facility.

That is, a large-sized refrigerator 1 may be manufactured with no need to use an additional forming facility, making it possible to reduce an investment in facilities and ensure efficiency in processing.

For the refrigerator 1 of the present disclosure, the coupling assembly 300 may be disposed on the rear surface of the first protrusion 130 of the first inner case 100 and the rear surface of the second protrusion 230 of the second inner case 200, to couple the first inner case 100 and the second inner case 200. Accordingly, an additional assembly line does not need to be provided on the front surface of the inner case 10.

Thus, an assembly line of the front surfaces of the inner cases, which are a main exterior factor of the refrigerator 1, may be reduced, ensuring an aesthetic exterior of the front surface of the refrigerator 1.

A back plate 400 coupled respectively to the first coupling plate 310 and the second coupling plate 320 may be additionally coupled to the rear surfaces of the first coupling plate 310 and the second coupling plate 320, to support and improve a fixation force, enabling the first inner case 100 and the second inner case 200 to be coupled and fixed firmly.

The coupling assembly 300 may comprise a pair of hinge mounting parts 312 at both sides thereof.

The pair of hinge mounting parts 312 may be a space in which the pair of lower hinges 32 coupled to the lower portions of the pair of first doors 11 is mounted.

Accordingly, the hinge mounting part 312 may be formed and disposed to correspond to an opening area that is formed by the first front surface 120, the first protrusion 130, the first side extension part 160, the second front surface 220, the second protrusion 230, and the second side extension par 260, and may be exposed outward with respect to the direction of the front surface of the refrigerator 1.

In the case where the coupling assembly 300 is formed in a way that separates into a first coupling plate 310 and a second coupling plate 320, the hinge mounting part 312 may be formed at the first coupling plate 310.

The hinge mounting part 312 is a space in which the lower hinge 32 coupled to the lower portion of the first door 11 opening and closing the first inner case 100 is mounted.

Since the lower hinge 32 is formed at the first coupling plate 310 relatively close to the first door 11, assembly tolerance that may occur in the process of assembling the first coupling plate 310 may be less than in the process of assembling the second coupling plate 320 relatively far from the first door 11.

In the state where the first door 11 and the second door 12 are removed, the first inner case 100 and the second inner case 200 may form the exterior of the front surface of the refrigerator 1.

When the user sees the refrigerator 1 from the front surface thereof, the user can hardly recognize a plurality of outer cases 20, while recognizing the front surfaces of the first inner case 100 and the second inner case 200.

In particular, in the case where the refrigerator 1 is a built-in refrigerator 1 that is combined with furniture or a home appliance and constitutes a wall, the user recognizes the front surfaces of the first inner case 100 and the second inner case 200 as the outer surface of the refrigerator 1.

Accordingly, the first front surface 120 of the first inner case 100 and the second front surface 220 of the second inner case 200 may form the exterior of the front surface of the refrigerator 1.

Further, the deco plate 500 coupled to the first protrusion 130 and the second protrusion 230 in a way that covers the first protrusion 130 and the second protrusion 230 may be disposed on the front surface of the first protrusion 130 of the first inner case 100 and the front surface of the second protrusion 230 of the second inner case 200.

The deco plate 500 may form the exterior of the front surface of the refrigerator 1.

At this time, the deco plate 500 may have a thickness that corresponds to a difference in the thicknesses of the first front surface 120 and the first protrusion 130 and a difference in the thicknesses of the second front surface 220 and the second protrusion 230.

The deco plate 500 may be disposed to fill a step between the first front surface 120 and the first protrusion 130 and a step between the second front surface 220 and the second protrusion 230.

The deco plate 500 forms a planar surface that is substantially the same as that of the first front surface 120 and the second front surface 220, providing an excellent design to the exterior of the front surface of the refrigerator 1.

The deco plate 500 forms a planar surface that is substantially the same as that of the first front surface 120 and the second front surface 220, such that the boundary line of each component, recognized by the user from the front surface of the refrigerator 1, is hidden at a maximum level, providing an excellent design to the exterior of the front surface of the refrigerator 1.

However, the way of forming the deco plate 500 is not limited. The deco plate 500 may be formed to protrude further than the first front surface 120 and the second front surface 220.

Additionally, a hinge cover 700 may be disposed on the front surface of the hinge mounting part 312.

The hinge cover 700 may also form the exterior of the front surface of the refrigerator 1.

At this time, the hinge cover 700 may have a thickness that corresponds to a difference in the thicknesses of the first front surface 120 and the first protrusion 130, and a difference in the thicknesses of the second front surface 220 and the second protrusion 230.

Thus, the hinge cover 700 may be disposed to fill a step between the first front surface 120 and the first protrusion 130 and a step between the second front surface 220 and the second protrusion 230.

Further, the hinge cover 700 may be formed to have a thickness that corresponds to a difference in the thicknesses of the first front surface 120 and the first side extension part 160 and a difference in the thicknesses of the second front surface 220 and the second side extension part 260.

Thus, the hinge cover 700 may be disposed to fill a step between the first front surface 120 and the first side extension part 160 and a step between the second front surface 220 and the second side extension part 260.

The hinge cover 700 may form a planar surface that is substantially the same as that of the first front surface 120 and the second front surface 220, providing an excellent design to the exterior of the front surface of the refrigerator 1.

However, the way of forming the hinge cover 700 is not limited. The deco plate 500 may be formed to protrude further than the first front surface 120 and the second front surface 220.

As described above, since the first front surface 120 of the first inner case 100 and the second front surface 220 of the second inner case 200 form the exterior of the front surface of the refrigerator 1, the number of components may decrease and efficiency in processing may improve with no need to add an additional exterior formation member.

In the case of a deco plate 500 and a hinge cover 700 that additionally form the exterior of the front surface of the refrigerator 1 in addition to the first front surface 120 and the second front surface 220, the deco plate 500 and the hinge cover 700 occupy a smaller surface area than the surface areas occupied by the first front surface 120 and the second front surface 220, with respect to the entire surface area of the exterior of the front surface of the refrigerator.

Accordingly, most of the exterior of the front surface of the refrigerator 1 may be substantially formed by the first front surface 120 and the second front surface 220 and depends on the first front surface 120 and the second front surface 220.

Further, a first hot line 610 may be disposed along the edge portion of the rear surface of the first front surface 120.

For example, the first front surface 120 may comprise a first bend part 122, the outer edge portion of which bends toward the rear surface of the first front surface 120.

The first bend part 122 may be formed along the upper surface and both lateral surfaces of the first front surface 120, and formed to extend up to an outer edge portion disposed on one surface of the first side extension part 160.

Accordingly, the first hot line 610 may be disposed along the inside of the first bend part 122, on the upper surface and both lateral surfaces of the first front surface 120, and disposed along the inside of the first protrusion 130, on the lower surface of the first front surface 120.

The first hot line 610 may be disposed between the first front surface 120 of the first inner case 100 and the first coupling plate 310 and may be fixed by the first coupling plate 310.

Additionally, a second hot line 620 may be disposed along the edge portion of the rear surface of the second front surface 220.

For example, the second front surface 220 may comprise a second bend part 222, the outer edge portion of which bends toward the rear surface of the second front surface 220.

The second bend part 222 may be formed along the upper surface and both lateral surfaces of the second front surface 220, and formed to extend up to an outer edge portion disposed on one surface of the second side extension part 260.

Accordingly, the second hot line 620 may be disposed along the inside of the second bend part 222, on the lower surface and both lateral surfaces of the second front surface 220, and disposed along the inside of the second protrusion 230, on the upper surface of the second front surface 220.

Additionally, in the case where the second inner case 200 comprises a plurality of second storage compartments 210 that separate from each other, the second hot line 620 may be disposed along the rear surface of the division part 221 disposed between the plurality of second storage compartments 310.

The second hot line 620 may be disposed between the second front surface 220 of the second inner case 200 and the second coupling plate 320, and fixed by the second coupling plate 320.

Figure 9:
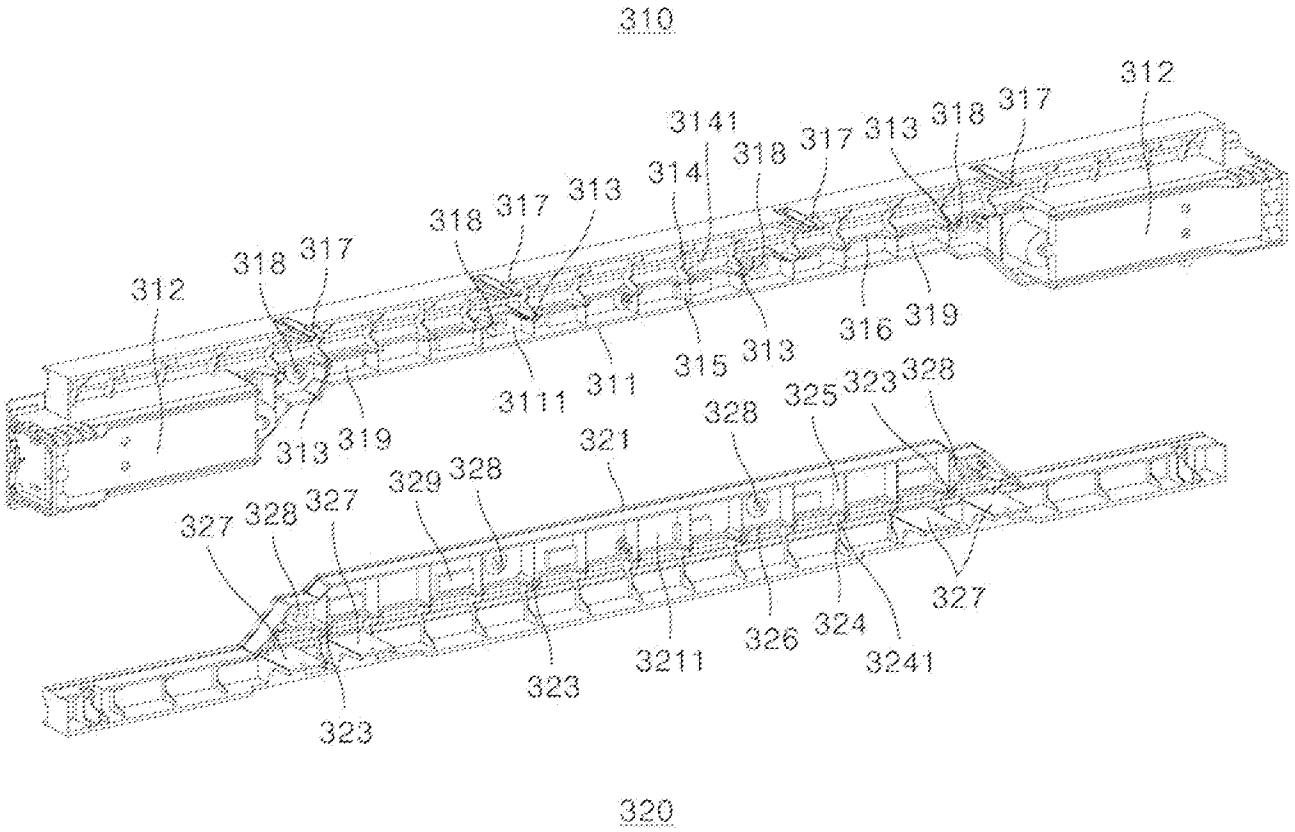
FIG. 9 is an exploded perspective view showing the rear surfaces of a first coupling plate and a second coupling plate.

The first coupling plate 310 and the second coupling plate 320 are specifically described with further reference to FIG. 9.

The first coupling plate 310 may be disposed along the lower surface of the first inner case 100 and coupled to the first protrusion 130, and entirely shaped into a long bar that extends in the left-right direction of the first inner case 100.

For example, for the first coupling plate 310, a plurality of first reinforcement ribs 314 elongated upward may be spaced apart from each other, at the upper side of the first support line 316, and a plurality of 1-1 reinforcement ribs 315 elongated downward may be spaced from each other, at the lower side of the first support line 316, around a first support line 316 that extends in the left-right direction.

The first support line 316, the first reinforcement rib 314 and the 1-1 reinforcement rib 315 may help to improve strength to constitute the basic skeleton of the first coupling plate 310.

The first reinforcement rib 314 may have a U or V shape with an inclined surface.

For example, one side of the first reinforcement rib 314 in contact with the upper side of the first support line 316 may be shaped into a first inclination part 3141 that inclines upward.

Accordingly, a plurality of first inclination parts 3141 may be arranged and spaced from each other at the upper side of the first support line 316.

A plurality of first rivet fastening parts 317 may protrude toward the rear surface of the first coupling plate 310 in a way that the plurality of first rivet fastening parts 317 is spaced from each other at the upper side of the first coupling plate 310.

Since the first storage compartment 110 of the first inner case 100 protrudes toward the rear surface of the first inner case 100, the first rivet fastening parts 317 protruding toward the rear surface of the first inner case 100 may protrude toward the lower surface of the first storage compartment 110 and fasten the first coupling plate 310 to the first storage compartment 110 based on a rivet coupling method.

A plurality of 1-1 rivet fastening parts 318 may be formed along one side of the first support line 316 in a way that the plurality of 1-1 rivet fastening parts 318 is spaced from each other.

The 1-1 rivet fastening parts 318 may be formed to face the first protrusion 130 and fasten the first coupling plate 310 to the first protrusion 130 based on a rivet coupling method.

A plurality of first rear surface fastening parts 313 may be formed along the first support line 316 and spaced from each other.

For example, the first rear surface fastening part 313 may be formed in an area where the first support line 316, the first reinforcement rib 314 and the 1-1 reinforcement rib 315 cross.

The first rear surface fastening part 313 may be formed to overlap the first support line 316 and have high strength, and may be shaped into a pillar protruding toward the rear surface of the first coupling plate 310.

The first rear surface fastening part 313 may be fastened to the back plate 400 by a fastening member such as a screw, and support the lower surface of the back plate 400.

Additionally, a plurality of first hook parts 319 may be formed along one side of the first support line 316 and spaced from each other.

The first hook part 319 may allow the deco plate 500 and the first coupling plate 310 to be fastened with the first protrusion 130 between the deco plate 500 and the first coupling plate 310. Description in relation to this is provided below.

A pair of hinge mounting parts 312 may be formed at both sides of the first support line 316.

The hinge mounting part 312 may be shaped into a box the front surface of which is open to allow the lower hinge 32 to be inserted into the hinge mounting part 312.

The first coupling plate 310 may have a depression part 3111 that is depressed toward the inside of the first support line 316, on the lower surface of the first coupling plate between the pair of hinge mounting parts 312.

For example, the depression part 3111 may be formed by a horizontal surface that is formed between a pair of inclination surfaces and a pair of inclination surfaces that are entirely formed to incline inward and upward from the pair of hinge mounting parts 312.

At this time, the inclination surfaces may be formed to have a step but not limited.

The inclination surface and the horizontal surface that form the depression part 3111, and the lower surface of the pair of hinge mounting parts 312 may be defined as a first combination surface 311.

The inclination surface and the horizontal surface that form the first combination surface 311, and the lower surface of the pair of hinge mounting parts 312 as described above are provided as an example, and the shape of the first combination surface 311 is not limited. The first combination surface 311 may have a variety of shapes, and the depression part 3111 corresponding to the first combination surface 311 may also have a variety of shapes.

Further, the second coupling plate 320 may be disposed along the upper surface of the second inner case 200 and coupled to the second protrusion 230, and entirely shaped into a long bar that is elongated in the left-right direction of the second inner case 200.

For example, for the second coupling plate 320, a plurality of second reinforcement ribs 324 elongated downward may be disposed at the lower side of the second support line 326 and space from each other, and a plurality of 2-1 reinforcement ribs 325 elongated upward may be disposed at the upper side of the second support line 326 and spaced from each other, around the second support line 326 elongated in the left-right direction.

The second support line 326, the second reinforcement rib 324 and the 2-1 reinforcement rib 325 may help to improve strength, to constitute the basic skeleton of the second coupling plate 320.

The second reinforcement rib 324 may have a U or V shape with an inclination surface.

For example, one side of the second reinforcement rib 324 in contact with the lower side of the second support line 326 may be formed as a second inclination surface 3214 that inclines downward.

Accordingly, a plurality of second inclination parts 3214 may be arranged at the lower side of the second support line 326 and spaced from each other.

A plurality of second rivet fastening parts 327 may protrude toward the rear surface of the second coupling plate 320 in a way that the plurality of second rivet fastening parts 327 is spaced from each other at the upper side of the second coupling plate 320.

Since the second storage compartment 210 of the second inner case 200 protrudes toward the rear surface of the second inner case 200, the second rivet fastening parts 327 protruding toward the rear surface of the second inner case 200 may protrude toward the lower surface of the second storage compartment 210 and fasten the second coupling plate 320 to the second storage compartment 210 based on a rivet coupling method.

A plurality of 2-1 rivet fastening parts 328 may be formed along one side of the second support line 326 in a way that the plurality of 2-1 rivet fastening parts 328 is spaced from each other.

The 2-1 rivet fastening parts 328 may be formed to face the second protrusion 230 and fasten the second coupling plate 320 to the second protrusion 230 based on a rivet coupling method.

A plurality of second rear surface fastening parts 323 may be formed along the second support line 326 and spaced from each other.

For example, the second rear surface fastening part 323 may be formed in an area where the second support line 326, the second reinforcement rib 324 and the 2-1 reinforcement rib 325 cross.

The second rear surface fastening part 323 may be formed to overlap the second support line 326 and have high strength, and may be shaped into a pillar that protrudes toward the rear surface of the second coupling plate 320.

The second rear surface fastening part 323 may be fastened to the back plate 400 by a fastening member such as a screw, and support the lower surface of the back plate 400.

Further, a plurality of second hook parts 329 may be formed along one side of the second support line 326 and spaced for each other.

The second hook part 329 may allow the deco plate 500 and the second coupling plate 320 to be fastened with the second protrusion 230 between the deco plate 500 and the second coupling plate 320. Description in relation to this is provided below.

The first coupling plate 310 may have an insertion part 3211 that is formed in a way that the upper surface of the first support line 316 protrudes upward.

For example, the insertion part 3211 may be formed in a way that the insertion part 3211 combines with the depression part 3111.

The upper surface of the second coupling plate 320, which has the insertion part 3211 is formed may be defined as a second combination surface 321.

The second combination surface 321 may be formed in a way that the second combination surface 321 combines with the first combination surface 311 of the first coupling plate 310.

Accordingly, the second combination surface 321 may be formed to correspond to the inclination surface and the horizontal surface forming the first combination surface 311, and the lower surface of the pair of hinge mounting parts 312.

However, as described above, the shapes of the first combination surface 311 and the depression part 3111 are not restricted. Accordingly, the shapes of the second combination surface 321 and the insertion part 3211, corresponding to the shapes of the first combination surface 311 and the depression part 3211, may vary in various different forms, depending on the shapes of the first combination surface 311 and the depression part 3111.

As described above, the first coupling plate 310 comprises the first combination surface 311 facing the second coupling plate 320, and the second coupling plate 320 comprises the second combination surface 321 facing the first coupling plate 310.

Since the insertion part 3211 of the second coupling plate 320 formed by the second combination surface 321 is combined with and inserted into the depression part 3111 of the first coupling plate 310 formed by the first combination surface 311, the first coupling plate 310 and the second coupling plate 320 may be coupled to each other in a combined structure.

The first coupling plate 310 and the second coupling plate 320 are coupled to each other in a combined structure and serve as a coupling guide, as described above, enabling the worker to adjust the coupling position of the first coupling plate 310 and the second coupling plate 320 readily and rapidly, without causing the worker to adjust the position precisely.

Figure 10:
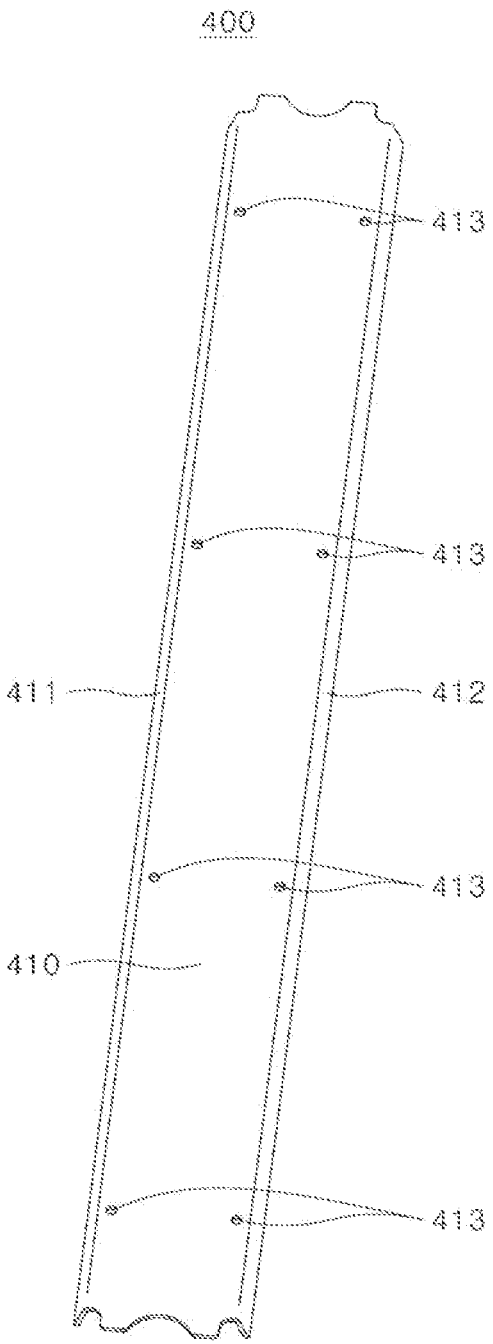
FIG. 10 is a view showing a back plate.

The back plate 400 is described specifically with further reference to FIG. 10.

The back plate 400 may comprise a body part 410 shaped into a plate that is elongated in one direction.

The body part 410 may have a first extension part 411 that extends from one side of both long sides of the body part 410 in a way that the first extension part 411 inclines downward and outward, and have a second extension part 412 that extends from the other side of both long sides of the body part 410 in a way that the second extension part 412 inclines downward and outward.

The back plate 400 shaped as described above may be disposed on the rear surfaces of the first coupling plate 310 and the second coupling plate 320, and coupled to the first coupling plate 310 and the second coupling plate 320 in a combined structure.

Specifically, the first extension part 411 of the back plate 400 may be formed to correspond to the first inclination part 3141 of the first coupling plate 310, and the second extension part 412 of the back plate 400 may be formed to correspond to a second inclination part 3241 of the second coupling plate 320.

For example, the first extension part 411 and the first inclination part 3141 may have a gradient that inclines at the same angle, and the second extension part 412 and the second inclination part 3241 may have a gradient that inclines at the same angle.

Accordingly, in the case where the back plate 400 is coupled to the first coupling plate 310 and the second coupling plate 320, the first extension part 411 and the second extension part 412 may contact and press the first inclination part 3141 and the second inclination part 3241 respectively.

The body part 410 may comprise a plurality of fastening holes 413.

The fastening hole 413 of the body part 410 may be disposed in a position corresponding to the position of the first rear surface fastening part 313 of the first coupling plate 310 and in a position corresponding to the position of the second rear surface fastening part 323 of the second coupling plate 320.

In the case where the back plate 400 is coupled to the first coupling plate 310 and the second coupling plate 320, the fastening hole 412 may contact and press the first rear surface fastening part 313 of the first coupling plate 310 and the second rear surface fastening part 323 of the second coupling plate 320 respectively.

At this time, the back plate 400 may be firmly fixed to the first coupling plate 310 and the second coupling plate 320 by an additional fastening member such as a screw that passes through the fastening hole 413 and is fastened to the first rear surface fastening part 313 and the second rear surface fastening part 323.

The coupling assembly described above may be formed integrally or separated in the up-down direction, for example, but may be combined in a separated manner in the left-right direction.

Figure 11:
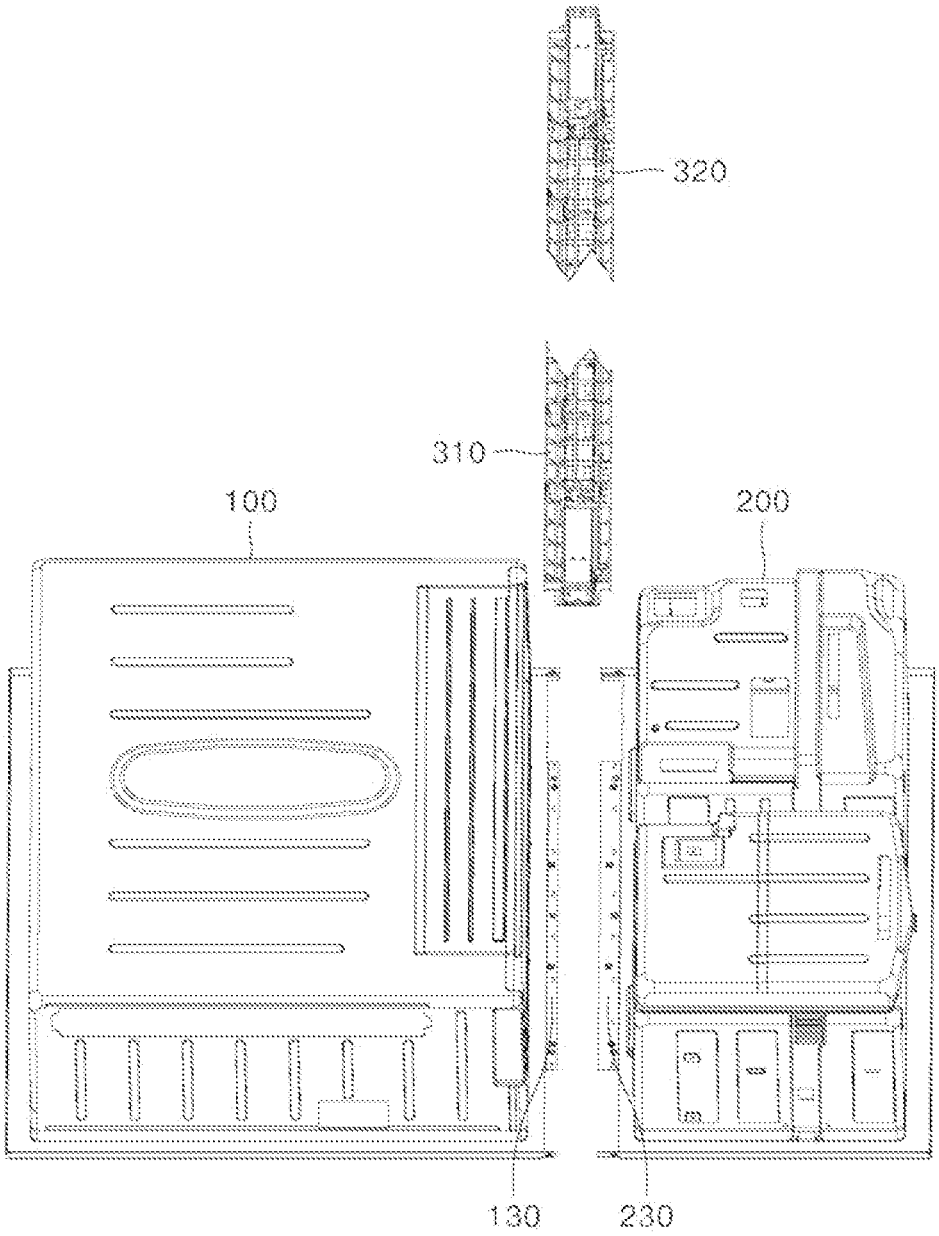
FIG. 11 is a view showing a first inner case and a second inner case separated from each other, and a first coupling plate and a second coupling plate separated from each other, in another embodiment.

Referring to FIG. 11, the coupling assembly may have a structure in which the first coupling plate 310 and the second coupling plate 320 separate in the left-right direction and combine.

Accordingly, the upper area of the front surface of the first coupling plate 310 may be coupled to the first protrusion 130, and the lower area of the front surface of the first coupling plate 310 may be coupled to the second protrusion 230.

Further, the upper area of the front surface of the second coupling plate 320 may be coupled to the first protrusion 130, and the lower area of the front surface of the second coupling plate 320 may be coupled to the second protrusion 230.

At this time, a shape in which the first coupling plate 310 and the second coupling plate 320 combine is not restricted as described above.

Hereafter, a manufacturing method of a refrigerator in one embodiment is described with reference to FIGS. 12 to 21.

Figure 12:
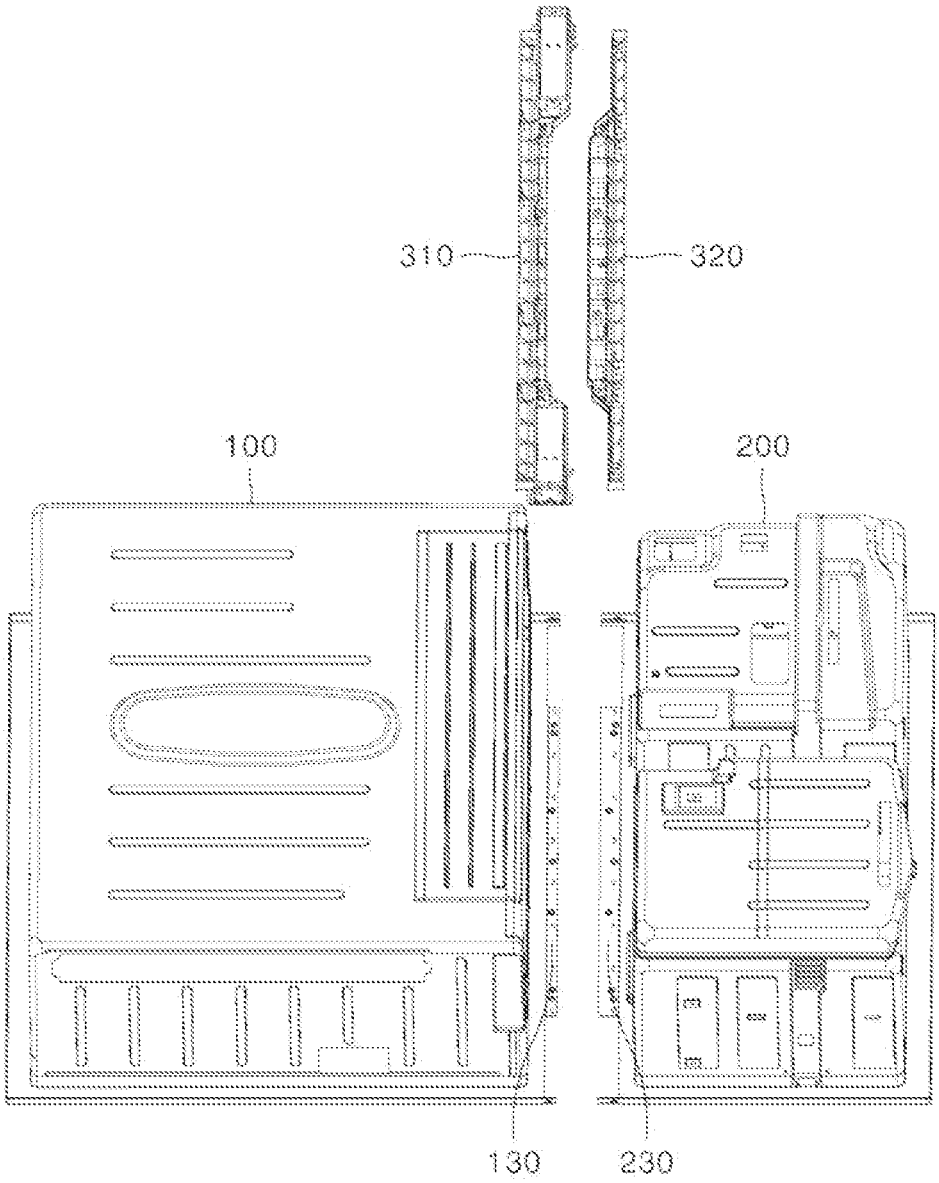
FIG. 12 is a view showing a first inner case and a second inner case separated from each other, and a first coupling plate and a second coupling plate separated from each other.

Referring to FIG. 12, the first inner case 100 comprising the first protrusion 130 that protrudes downward from the front of the first inner case 100, and the second inner case 200 comprising the second protrusion 230 that protrudes upward from the front of the second inner case 200 may be separately formed.

For the first inner case 100 and the second inner case 200 separately formed, the first protrusion 130 and the second protrusion 230 are disposed to face each other, in a way that the rear surfaces of the first protrusion 130 and the second protrusion 230 face upward.

Additionally, the first coupling plate 310 and the second coupling plate 320 separately formed may be prepared separately.

Figure 13:
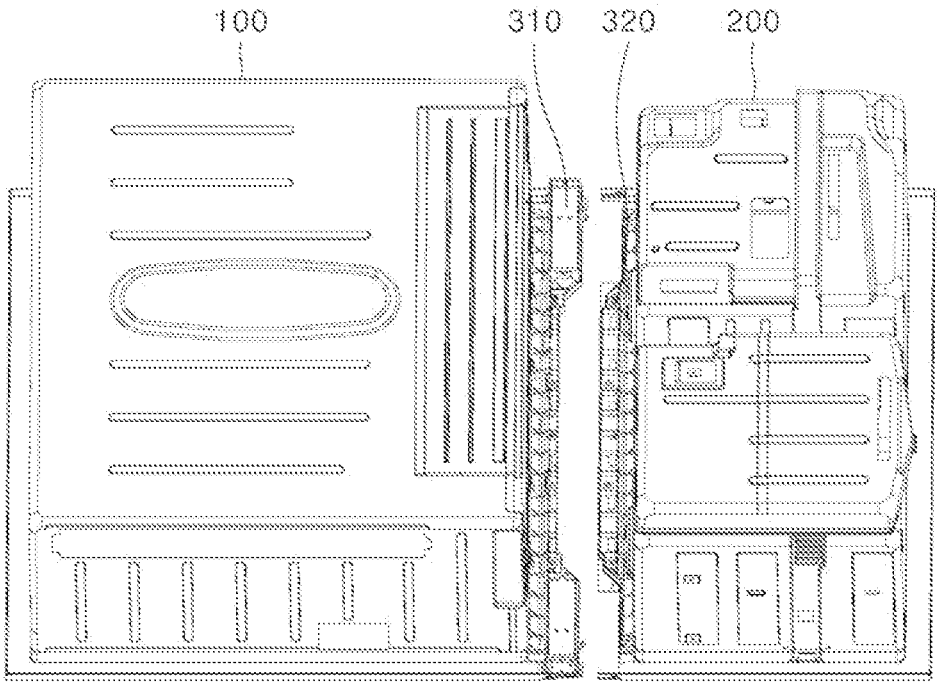
FIG. 13 is a view showing that a first coupling plate is coupled to the rear surface of a first inner case and that a second coupling plate is coupled to the rear surface of a second inner case.

Referring to FIG. 13, the first coupling plate 310 and the second coupling plate 320 may be respectively coupled to the rear surface of the first protrusion 130 and the rear surface of the second protrusion 230.

At this time, before the first coupling plate 310 and the second coupling plate 320 are respectively coupled to the rear surface of the first protrusion 130 and the rear surface of the second protrusion 230, the first hot line 610 and the second hot line 620 may be respectively disposed along the rear surface of the first inner case 100 and the rear surface of the second inner case 200.

If the inner case 10 has a structure in which the first inner case 100 and the second inner case 200 are integrated rather than separating, the two hot lines need to be disposed at the same time, causing difficulty in processing, in the case where the first hot line 610 and the second hot line 620 are disposed on the rear surface of the inner case 10.

In the present disclosure, since the first hot line 610 and the second hot line 620 are respectively disposed in the first inner case 100 and the second inner case 200 that are separate from each other, the first hot line 610 and the second hot line 620 may be disposed in a different separate process.

Thus, in the present disclosure, the hot lines do not need to be disposed and fixed at the same time, and each of the hot lines may be disposed based on separate processing, ensuring improvement in the efficiency of disposing and fixing the hot lines.

Figure 14:
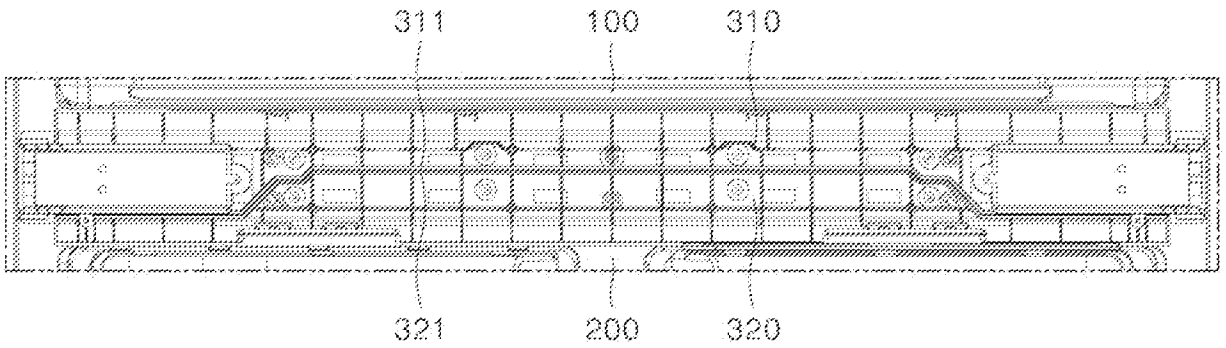
FIG. 14 is a view showing the rear surface of a first coupling plate and a second coupling plate in the state where the first coupling plate and the second coupling plate combine.
Figure 15:
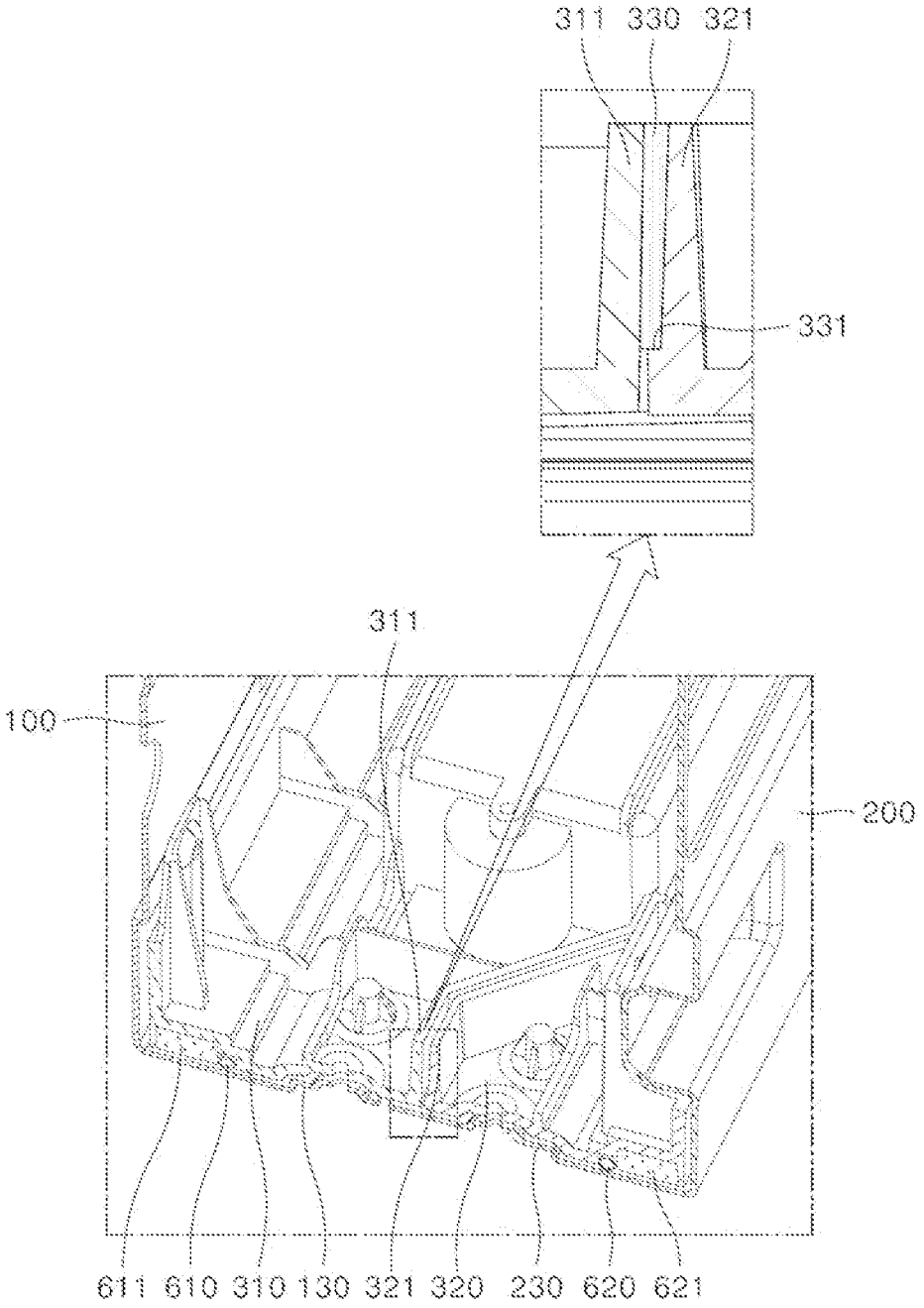
FIG. 15 is a cross-sectional view showing the state where a first coupling plate and a second coupling plate combine.

Referring to FIGS. 14 and 15, the first inner case 100 and the second inner case 200 may be disposed in a way that the first coupling plate 310 and the second coupling plate 320 face each other.

At this time, the first combination surface 311 of the first coupling plate 310 and the second combination surface 321 of the second coupling plate 320 having a structure in which the first combination surface 311 and the second combination surface 321 combine with each other may be coupled to and combined with each other.

In the present disclosure, the first inner case 100 and the second inner case 200 separated from each other are coupled to the first coupling plate 310 and the second coupling plate 320 that combine on their rear surfaces, and when the worker couples each component, the combined structure guides a coupling between the first coupling plate 310 and the second coupling plate 320, enabling the coupling without a precise coupling process and ensuring improvement in the efficiency of processing.

A gasket foam 330 may be disposed along a surface between the first combination surface 311 and the second combination surface 321.

As the inner case 10 and the outer case 20 are assembled, the outer case 20 and the inner case 10 may be formed to have a separation space therebetween, and an insulation material may foam in the separation space.

At this time, the gasket foam 330 may prevent the leakage of the insulation material from between the first combination surface 311 and the second combination surface 321.

The first combination surface 311 may have a holding jaw 331 into which the gasket foam 330 is inserted and which supports the lower portion of the gasket foam 330, but not be limited. The second combination surface 321 may have a holding jaw 331.

Additionally, the first coupling plate 310 and the second coupling plate 320 may respectively fix the first hot line 610 and the second hot line 620.

Accordingly, the first hot line 610 may be disposed and fixed between the rear surface of the first inner case 100 and the first coupling plate 310.

At this time, the first support part 611 may be disposed in a separation space that may be created between the rear surface of the first inner case 100 and the first coupling plate 310, to prevent the first hot line 610 from moving in the separation space.

Further, the second hot line 620 may be disposed and fixed between the rear surface of the second inner case 200 and the second coupling plate 320.

At this time, the second support part 621 may be disposed in a separation space that may be created between the rear surface of the second inner case 200 and the second coupling plate 320, to prevent the second hot line 620 from moving in the separation space.

Figure 16:
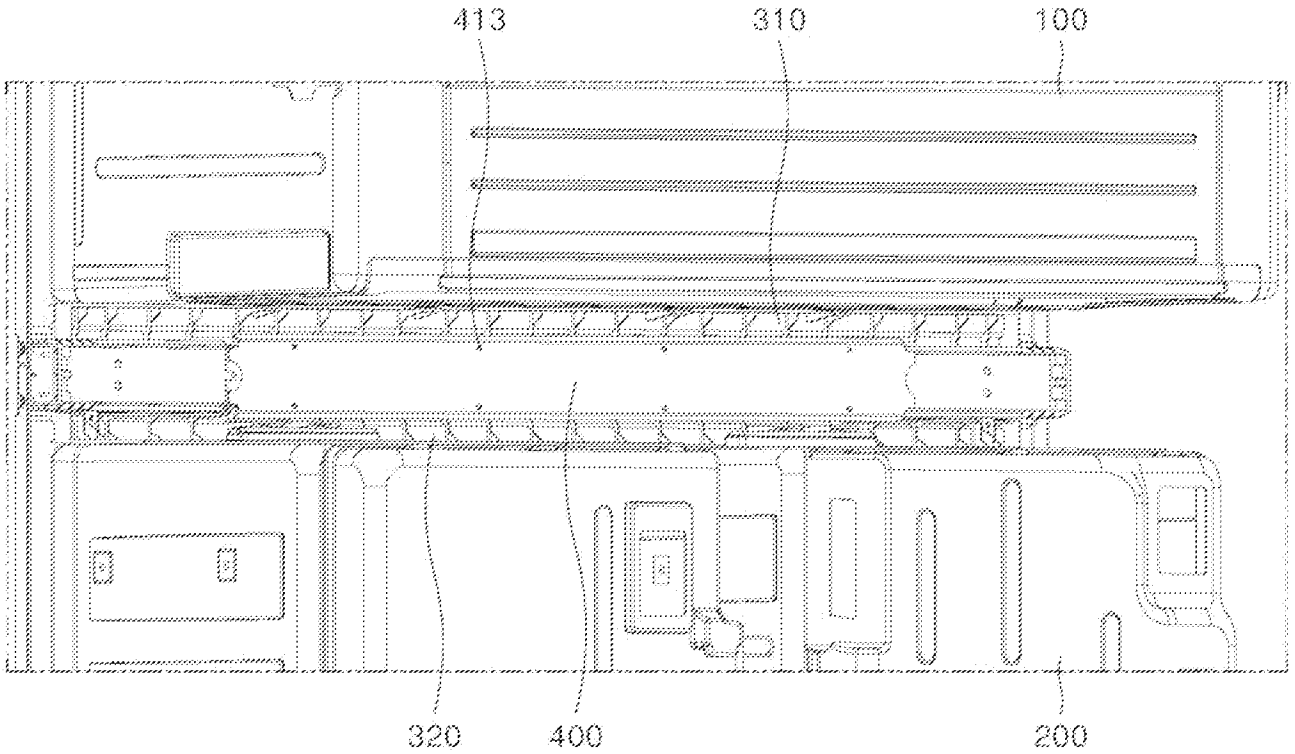
FIG. 16 is a view showing a rear surface of a first coupling plate and a second coupling plate in the state where a back plate combines with the rear surfaces of the first coupling plate and the second coupling plate.
Figure 17:
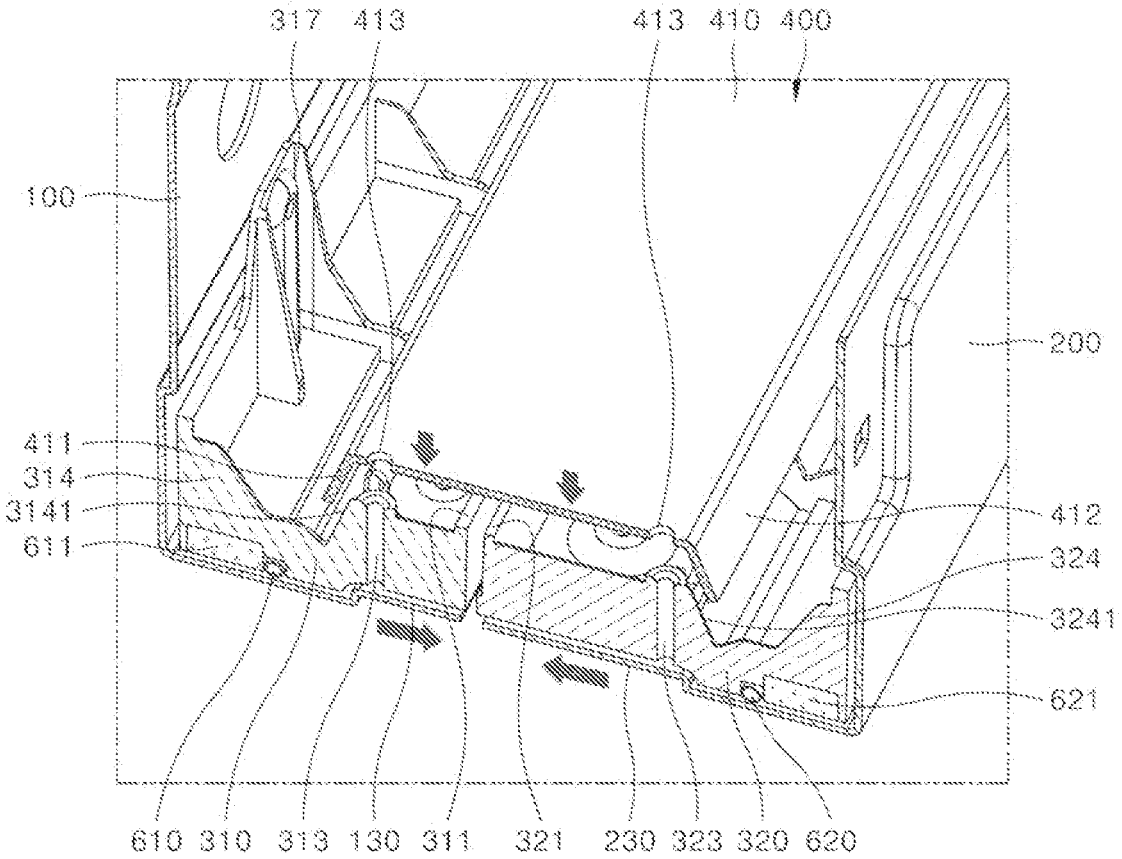
FIGS. 17 and 18 are cross-sectional views respectively showing the state where a back plate does not combine with the rear surfaces of a first coupling plate and a second coupling plate and the state where a back plate combines with the rear surfaces of a first coupling plate and a second coupling plate.
Figure 18:
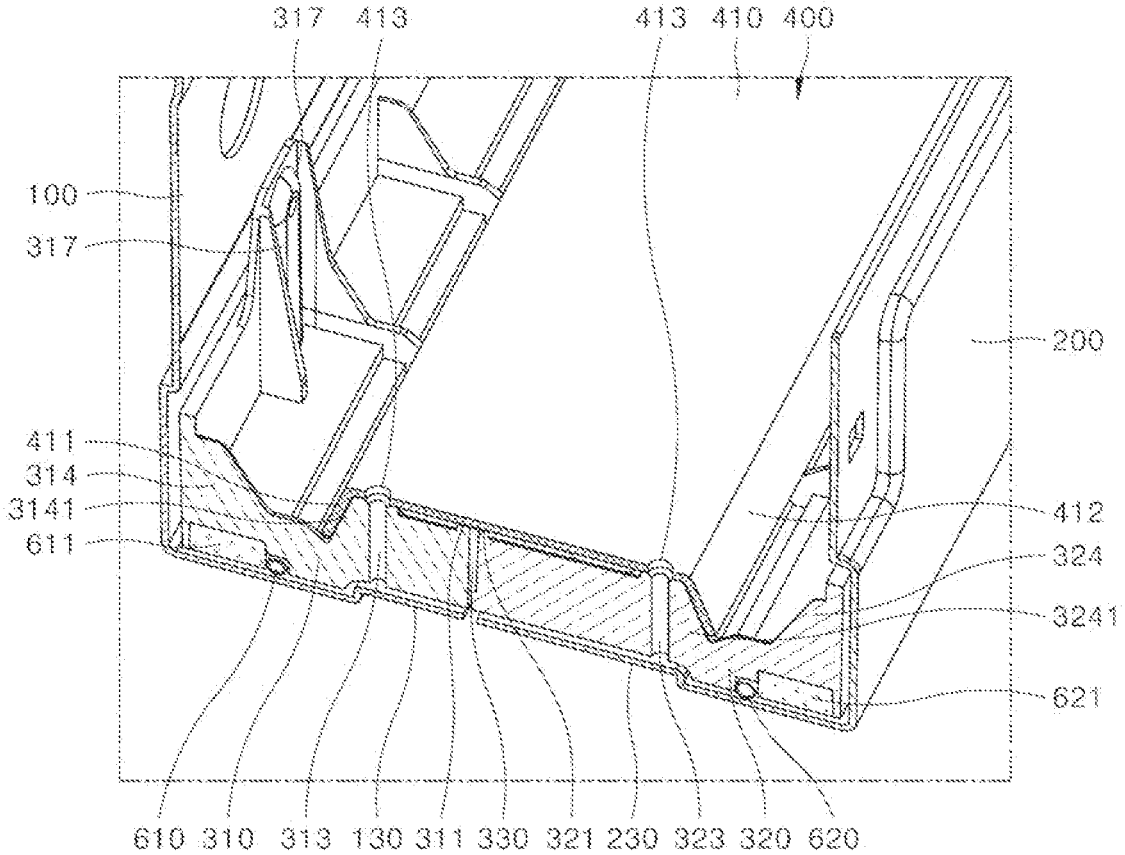

Referring to FIGS. 16 to 18, the back plate 400 may be coupled to the rear surfaces of the first coupling plate 310 and the second coupling plate 320.

As described above, the back plate 400 may be formed in a structure where the back plate 400 combines with the rear surfaces of the first coupling plate 310 and the second coupling plate 320.

Accordingly, the first extension part 411 and the second extension part 412 of the back plate 400 may be disposed to correspond respectively to the first inclination part 3141 of the first coupling plate 310 and the second inclination part 3241 of the second coupling plate 320, and the fastening hole 413 of the back plate 400 may be disposed to correspond to the first rear surface fastening part 313 of the first coupling plate 310 and the second rear surface fastening part 323 of the second coupling plate 320.

Since the back plate 400 may be made of a metallic plate such as sheet metal, the back plate 400 may weigh more than the first coupling plate 310 and the second coupling plate 320 that are formed as an injection form.

Thus, the back plate 400 may naturally press the first extension part 411 and the second extension part 412 respectively along the first inclination part 3141 and the second inclination part 3241, based on its weight, by using its inclination structure.

Referring to FIG. 17, the first coupling plate 310 and the second coupling plate 320 may move to contact each other closely in the direction where the first coupling plate 310 and the second coupling plate 320 face each other, because of the weight applied downward by the back plate 400, for example.

Accordingly, even in the case where the first coupling plate 310 and the second coupling plate 320 are not disposed in a position where the first coupling plate 310 and the second coupling plate 320 combine accurately, in the previous process, the first coupling plate 310 and the second coupling plate 320 may gather in the right position naturally and precisely, based on pressurization caused by the weight of the back plate 400, by using the combined structure of the first extension part 411 and the second extension part 412 and the first inclination part 3141 and the second inclination part 3241.

According to the present disclosure, since the first coupling plate 310 and the second coupling plate 320 is coupled to the back plate 400 having a structure in which the back plate 400 combines with the first coupling plate 310 and the second coupling plate 320, the combined structure guides the coupling, ensuring the coupling and improvement in processing efficiency, without a precise coupling process, when the worker couples each component.

Referring to FIG. 18, the back plate 400 may couple and fix the first coupling plate 310 to the second coupling plate 320 through a fastening member such as a screw that passes through the fastening hole 413 of the back plate 400 disposed to correspond to the first rear surface fastening part 313 of the first coupling plate 310 and the second rear surface fastening part 323 of the second coupling plate 320.

According to the present disclosure, the rear surfaces of the first inner case 100 and the second inner case 200 separated from each other are coupled, by the first coupling plate 310 and the second coupling plate 320 and additionally by the back plate 400. Accordingly, the first inner case 100 and the second inner case 200 may be temporarily assembled, based on the coupling on the rear surfaces of the first inner case 100 and the second inner case 200, with no need to fix the first coupling plate 310 and the second coupling plate 320 on the front surface of the refrigerator 1, ensuring improvement in processing efficiency.

Then the outer case 20 is assembled to the inner case 10 to surround the outer surfaces of the first inner case 100 and the second inner case 200 except for the front surfaces of the first inner case 100 and the second inner case 200, and a foaming liquid is injected into the outer case 20 to fill between the inner case 10 and the outer case 20 with an insulation material.

According to the present disclosure, the first inner case 100 and the second inner case 200 may be coupled only by disposing the first coupling plate 310 and the second coupling plate 320 along the center line of the front of the inner case 10 and coupling the first coupling plate 310 and the second coupling plate 320. Thus, the rear spaces of the first coupling plate 310 and the second coupling plate 320 may remain as a maximum vacant space.

The entire vacant space may be filled with a foaming liquid, ensuring improvement in the thermal insulation performance of the refrigerator 1.

Additionally, the worker may perform a job only on the rear surface of the inner case 10 until the foaming liquid is injected, without rotating the inner case 10 to perform a job on the front surface of the inner case 10, ensuring significant improvement in workability of the worker.

Figure 19:
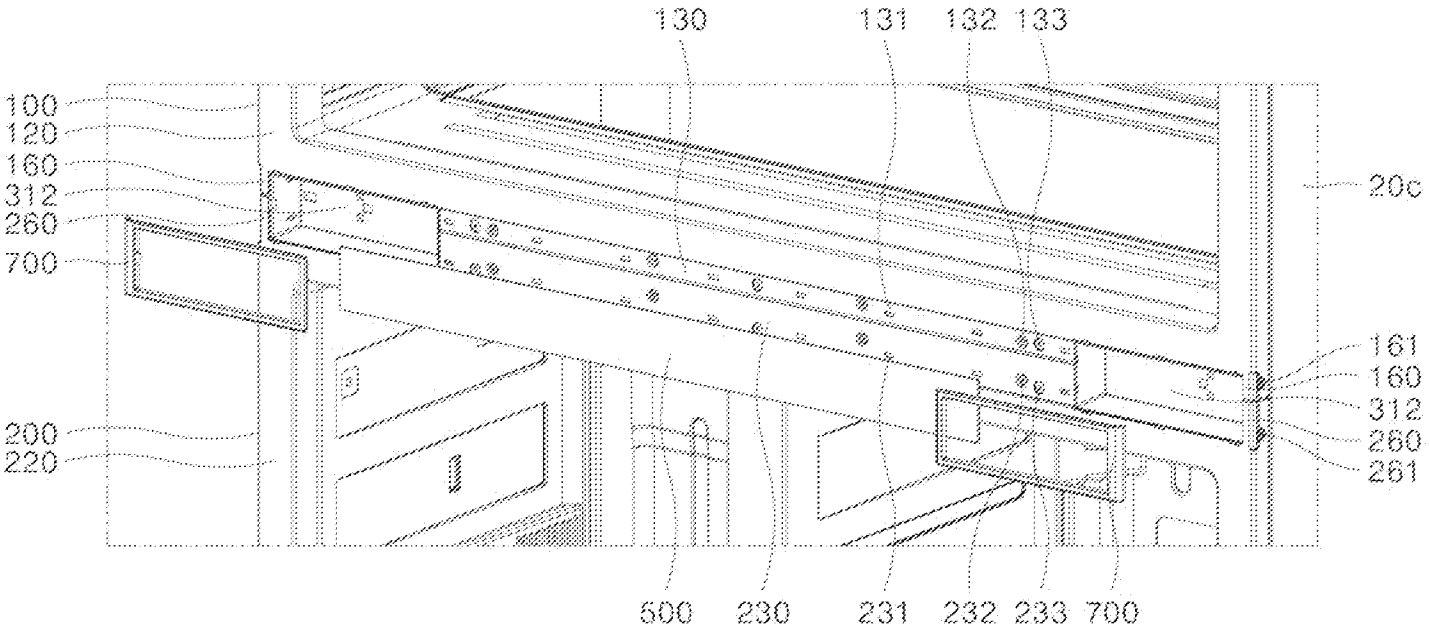
FIGS. 19 and 20 are respectively front perspective views showing the state where a deco plate and a hinge cover are not coupled to the front surfaces of a first protrusion and a second protrusion and the state where a deco plate and a hinge cover are coupled to the front surfaces of a first protrusion and a second protrusion.
Figure 20:
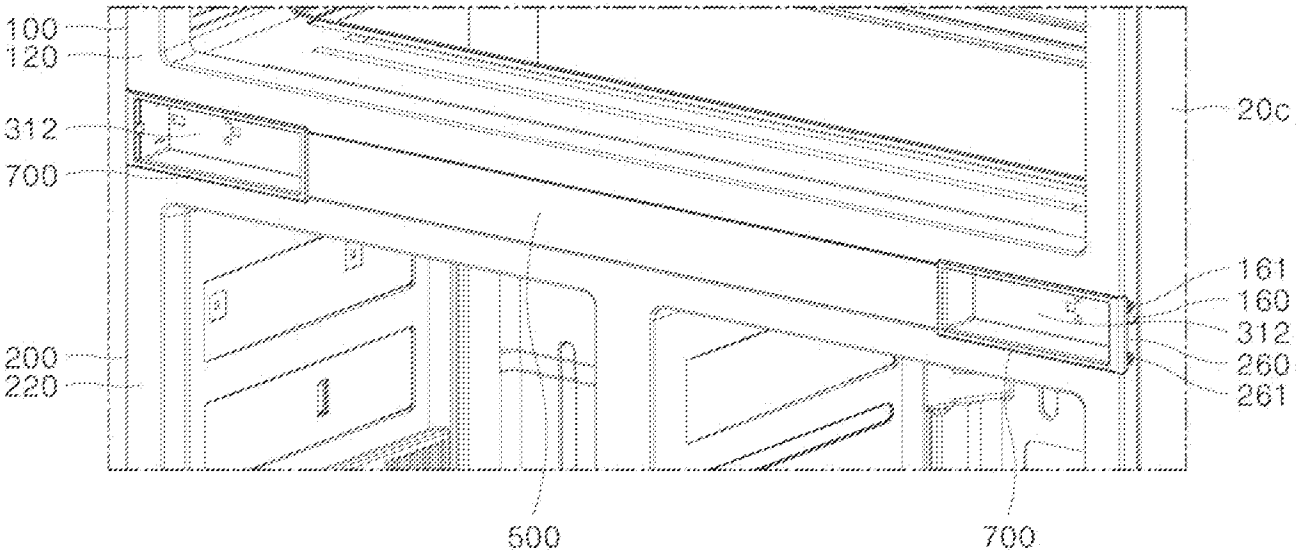
Figure 21:
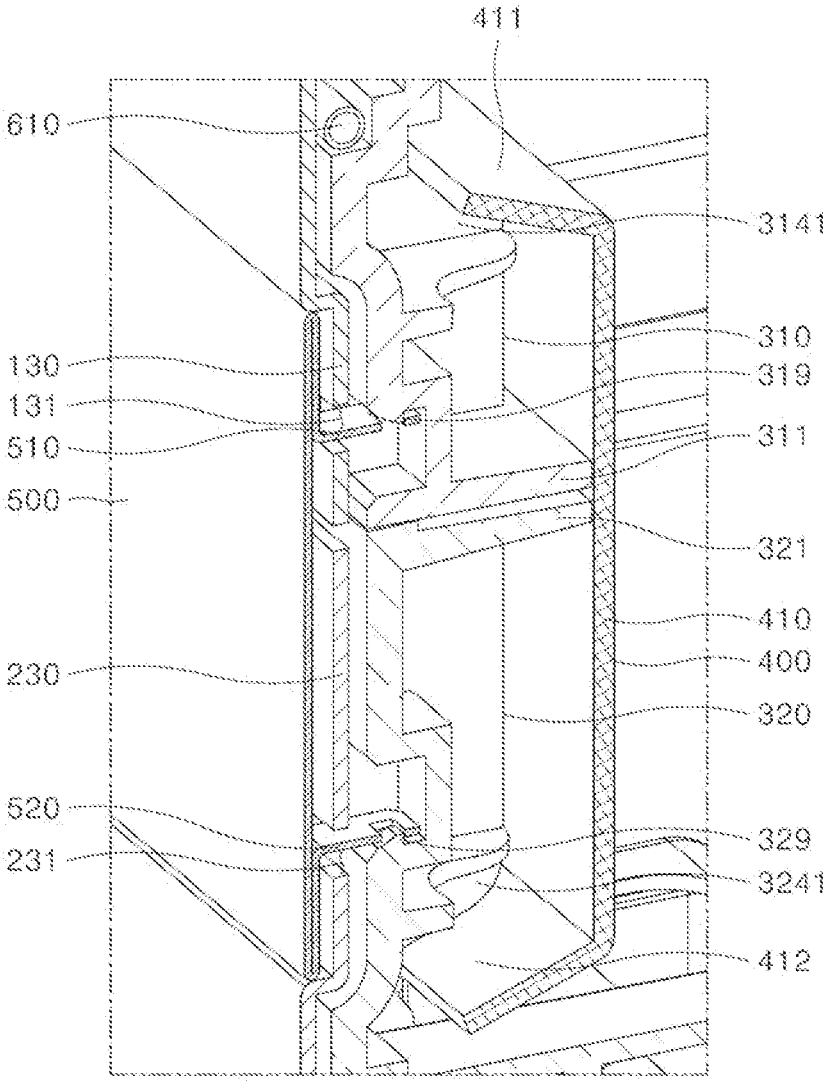
FIG. 21 is a cross-sectional view showing the state where a deco plate is coupled to the front surfaces of a first protrusion and a second protrusion.

Referring to FIGS. 19 to 21, the deco plate 500 and the hinge cover 700 may be coupled to the front surfaces of the first protrusion 130 and the second protrusion 230.

A plurality of 1-1 rivet fastening holes 132 is formed to correspond to the 1-1 rivet fastening parts 318 of the first coupling plate 310, at the first protrusion 130, such that the first protrusion 130 and the first coupling plate 310 are coupled by a rivet.

Additionally, a plurality of 2-1 rivet fastening holes 232 is formed to correspond to the 2-1 rivet fastening parts 328 of the second coupling plate 320, at the second protrusion 230, such that the second protrusion 230 and the second coupling plate 320 are coupled by a rivet.

Further, a plurality of first front surface fastening holes 133 is formed at the first protrusion 130, and a plurality of second front surface fastening holes 233 is formed at the second protrusion 230, such that a fastening member such as a screw passes through the first protrusion 130 and the second protrusion 230 in the direction of the front surface of the first protrusion 130 and the second protrusion 230 and is additionally fixed to the first coupling plate 310 and the second coupling plate 320 disposed on the rear surface of the first protrusion 130 and the second protrusion 230.

A first fixation hole 161 is formed on the lateral surface of the first side extension part 160 of the first coupling plate 310, to be fixed to the first coupling plate 310 additionally in the direction of the lateral surface of the first side extension part 160, and a second fixation hole 261 is formed on the lateral surface of the second side extension part 260 of the second coupling plate 320, to be fixed to the second coupling plate 320 additionally in the direction of the lateral surface of the second side extension part 260.

Referring to FIG. 21, the deco plate 500 is shaped into a long plate that is elongated in the left-right direction, and have a plurality of first hook holding parts 510 and a plurality of second hook holding parts 520 that protrude in the direction of the rear surface of the deco plate 500, on the rear surface thereof.

The first hook holding part 510 may be formed in the upper area of the rear surface of the deco plate 500 in away that the first hook holding part 510 bends in the direction of the rear surface of deco plate 500, and the second hook holding part 520 may be formed in the lower area of the rear surface of the deco plate 500 in a way that the second hook holding part 520 bends in the direction of the rear surface of the deco plate 500.

The position and the number of the first hook holding parts 510 may be formed to correspond to the position and the number of first hook penetration holes 131 formed at the first protrusion 130 and the position and the number of the first hook parts 319 of the first coupling plate 310, and the position and the number of the second hook holding parts 520 may be formed to correspond to the position and the number of second hook penetration holes 231 formed at the second protrusion 230 and the position and the number of the second hook parts 329 of the second coupling plate 320.

The first hook holding part 510 may pass through the first hook penetration hole 131 and be held and fixed by the first hook part 319, and the second hook holding part 520 may pass through the second hook penetration hole 231 and be held and fixed by the second hook part 329.

Accordingly, the deco plate 500, and each of the first coupling plate 310 and the second coupling plate 320 may be coupled and fixed readily and rapidly, based on a simple hook coupling structure, with the first protrusion 130 and the second protrusion 230 therebetween.

Hereafter, in another embodiment, the first inner case 100 and the second inner case 200 coupled and fixed by a coupling member 900 of one embodiment are described with reference to FIGS. 22 to 24.

Description of the above particulars is omitted, and description of differences is provided.

The first protrusion 130 of the first inner case 100 and the second protrusion 230 of the second inner case 200 may be removed.

Without the first protrusion 130 and the second protrusion 230, a coupling member 900 may be provided to couple and fix the first inner case 100 and the second inner case 200.

Figure 22:
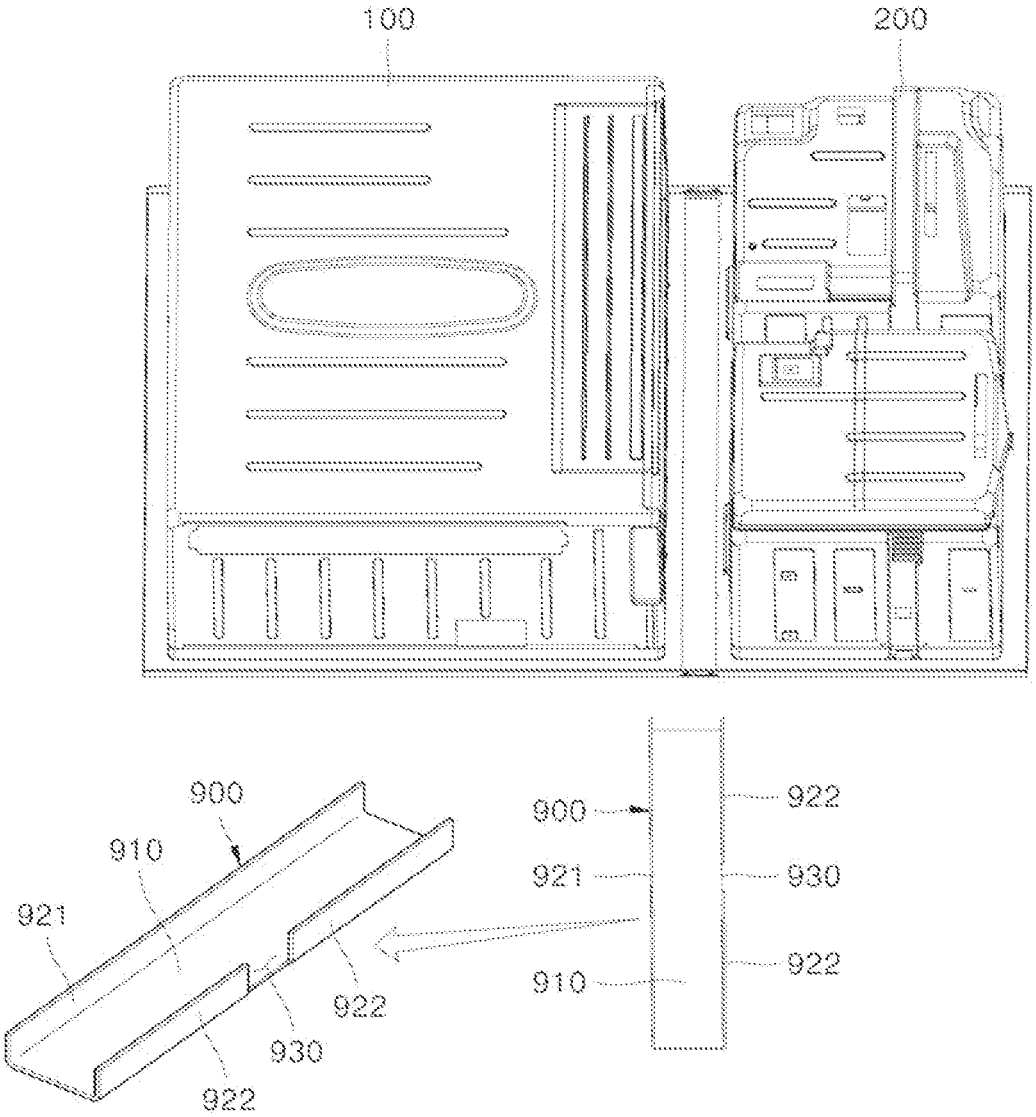
FIGS. 22 to 24 are views showing that a plurality of cases is coupled and fixed by a coupling member of one embodiment.

Referring to FIG. 22, the coupling member 900 may comprise a connection part 910 forming a body, and a first fixation part 921 and a second fixation part 922 that respectively extend in one lateral direction side by side from the end portions of both sides of the connection part 910.

For example, the connection part 910 may have a long bar-type plate shape that is elongated in one lateral direction to have a long side and a short side.

The first fixation part 921 and the second fixation part 922 may be formed to bend to the rear of the connection part 910, where the first inner case 100 and the second inner case 200 are disposed, along the long side of the connection part 910.

The coupling member 900 may have a "T" shape entirely.

For the coupling member 900 of FIG. 22, a groove part 930 is formed between a pair of second fixation parts 922 formed at one side of the coupling member 900, for example.

Figure 23:
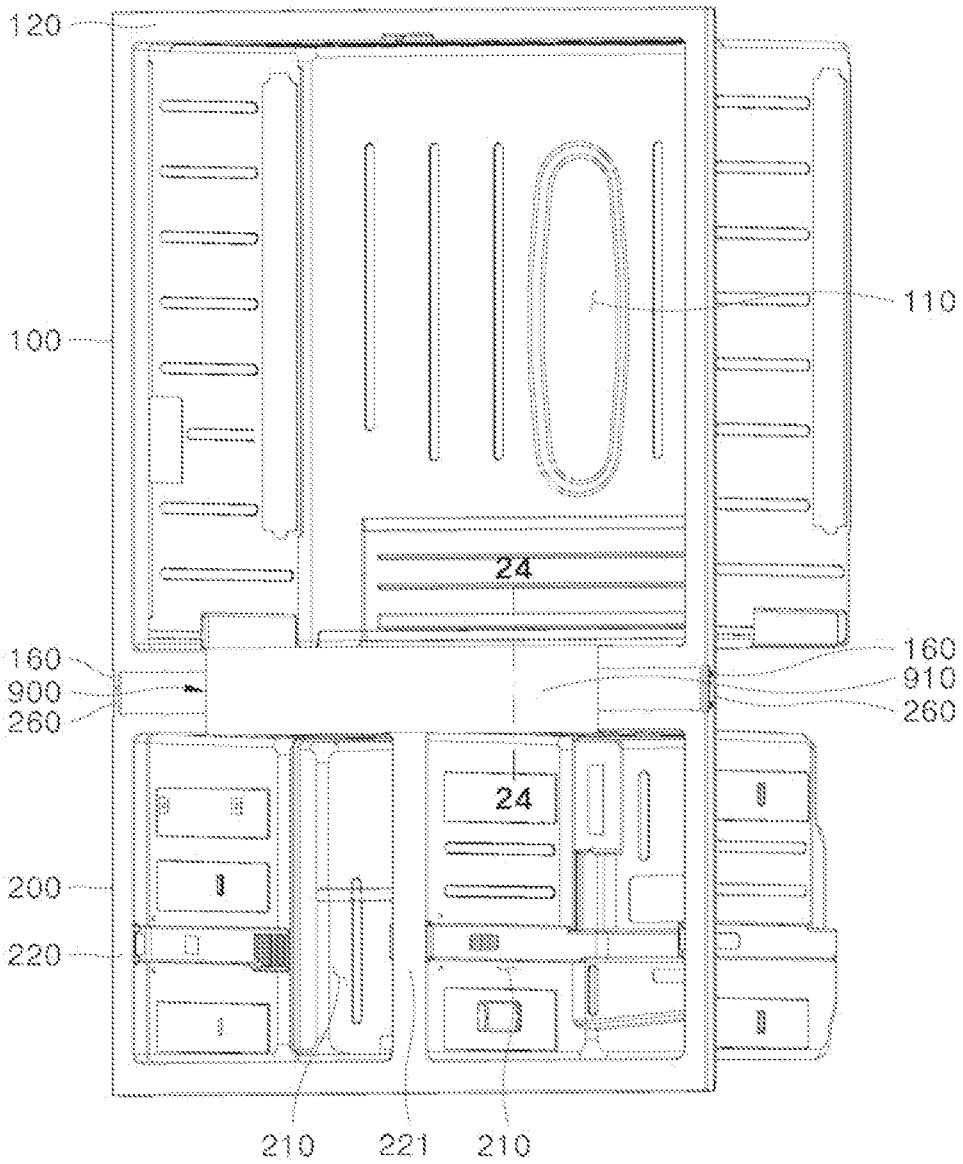
Figure 24:
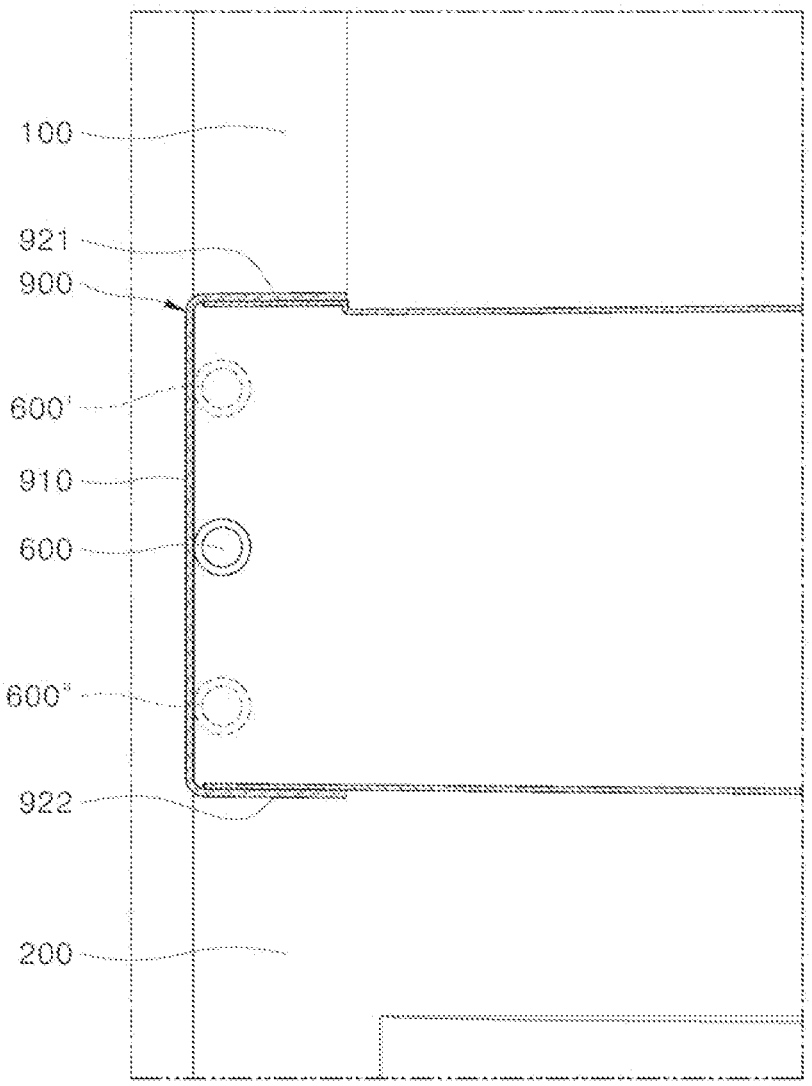

The shape of the second fixation part 922 is changed to correspond to the shape of the second inner case 200 the inner space of which is divided by the division part 221, as illustrated in FIG. 23.

Accordingly, the shape of the second fixation part 922 is not limited, and like the first fixation part 921, may be formed to connect continuously without an additional groove part.

The coupling member 900 may be made of a variety of materials such as a plastic injection form or sheet metal made of a metallic material, but not limited.

The coupling member 900 may be coupled to the first inner case 100 and the second inner case 200 from the front thereof to the rear thereof.

The first fixation part 921 may be inserted into the lower surface of the first inner case 100, and the second fixation part 922 may be inserted into the upper surface of the second inner case 200.

Referring to FIG. 23, a groove part 930 of the coupling member 900 may be disposed to correspond to the division part 221 of the second inner case 200, and the second fixation part 922 may be disposed at both sides of the division part 221.

The first fixation part 921 contacting the inner surface of the lower surface of the first inner case 100, and the second fixation part 922 contacting the inner surface of the upper surface of the second inner case 200 may be fastened respectively to the first inner case 100 and the second inner case 200.

The first fixation part 921 and the second fixation part 922 of the coupling member 900 may be fixed by various types of fastening structures such as a screw or a rivet and the like, and fastening structures are not limited.

Since the first inner case 100 and the second inner case 200 are coupled through the coupling member 900 having the above shape, the first inner case 100 and the second inner case 200 do not need to have an additional protrusion for a coupling to the first inner case 100 and the second inner case 200, ensuring the simplification of a coupling structure and the ease of coupling of cases having various shapes.

A hot line 600 may be disposed on the rear surface of the coupling member 900.

For example, the hotline 600 may be disposed at the rear of the central area of the coupling member 900.

However, the position of the hot line 600 is not limited. A hot line 600' may be disposed at the rear of the upper area of the coupling member 900 in a way that the hot line 600' is eccentric to the first inner case 100, or a hot line 600" may be disposed at the rear of the lower area of the coupling member 900 in a way that the hot line 600" is eccentric to the second inner case 200.

Additionally, the back plate 400 may be additionally disposed on the rear surface of the coupling member 900 to improve strength, but not limited.

In another embodiment, the first inner case 100 and the second inner case 200 coupled and fixed by a coupling member 900 of another embodiment are described with reference to FIGS. 25 to 27.

Figure 25:
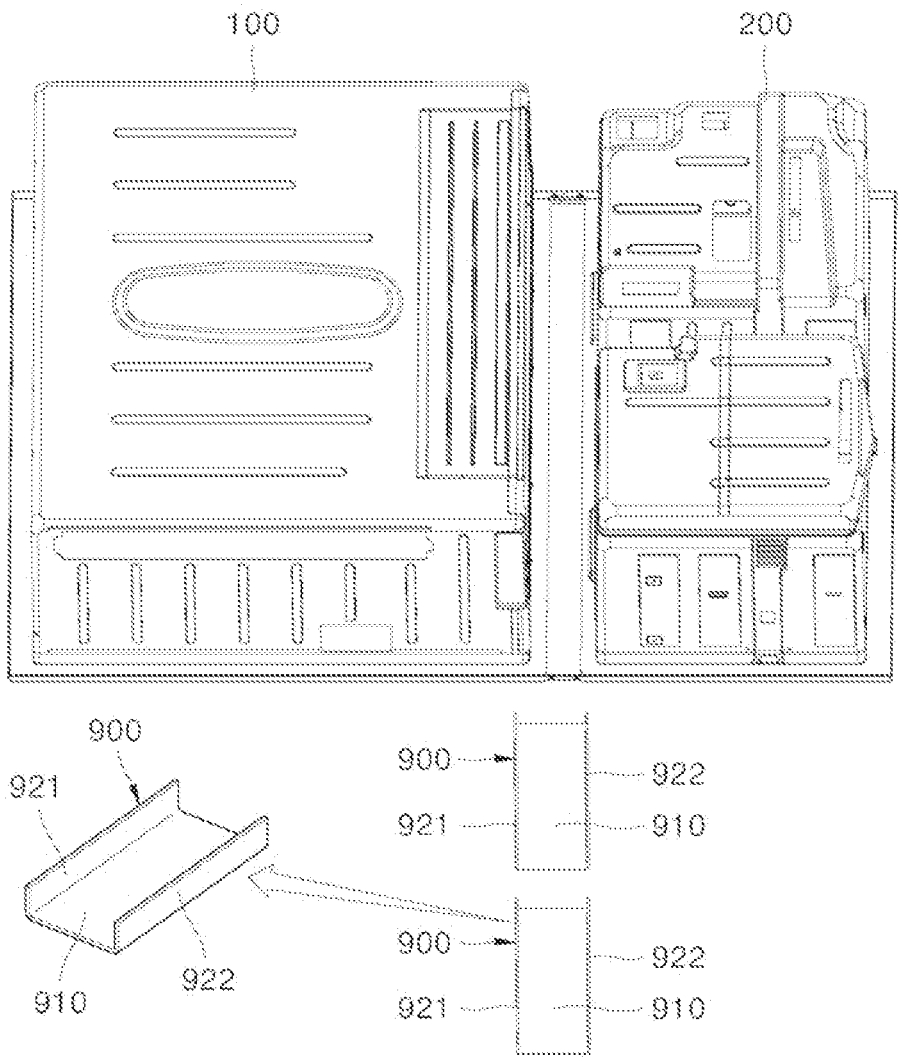
FIGS. 25 to 27 are views showing that a plurality of cases is coupled and fixed by a coupling member of another embodiment.

Referring to FIG. 25, a plurality of coupling members 900 is provided to couple and fix the first inner case 100 and the second inner case 200.

At this time, each coupling member 900 may comprise a connection part 910 having a long bar-type plate shape that is elongated in one lateral direction to have a long side and a short side, and a first fixation part 921 and a second fixation part 200 that are formed to bend to the rear of the connection part 910, where the first inner case 100 and the second inner case 200 are disposed, along the long side of the connection part 910.

The first fixation part 921 and the second fixation part 922 may be formed to extend and have the same shape.

Accordingly, the coupling member 900 may have a "T" shape entirely.

The long side of the coupling member 900 in FIG. 25 may be less than the long side of the coupling member 900 in FIG. 22.

Figure 26:
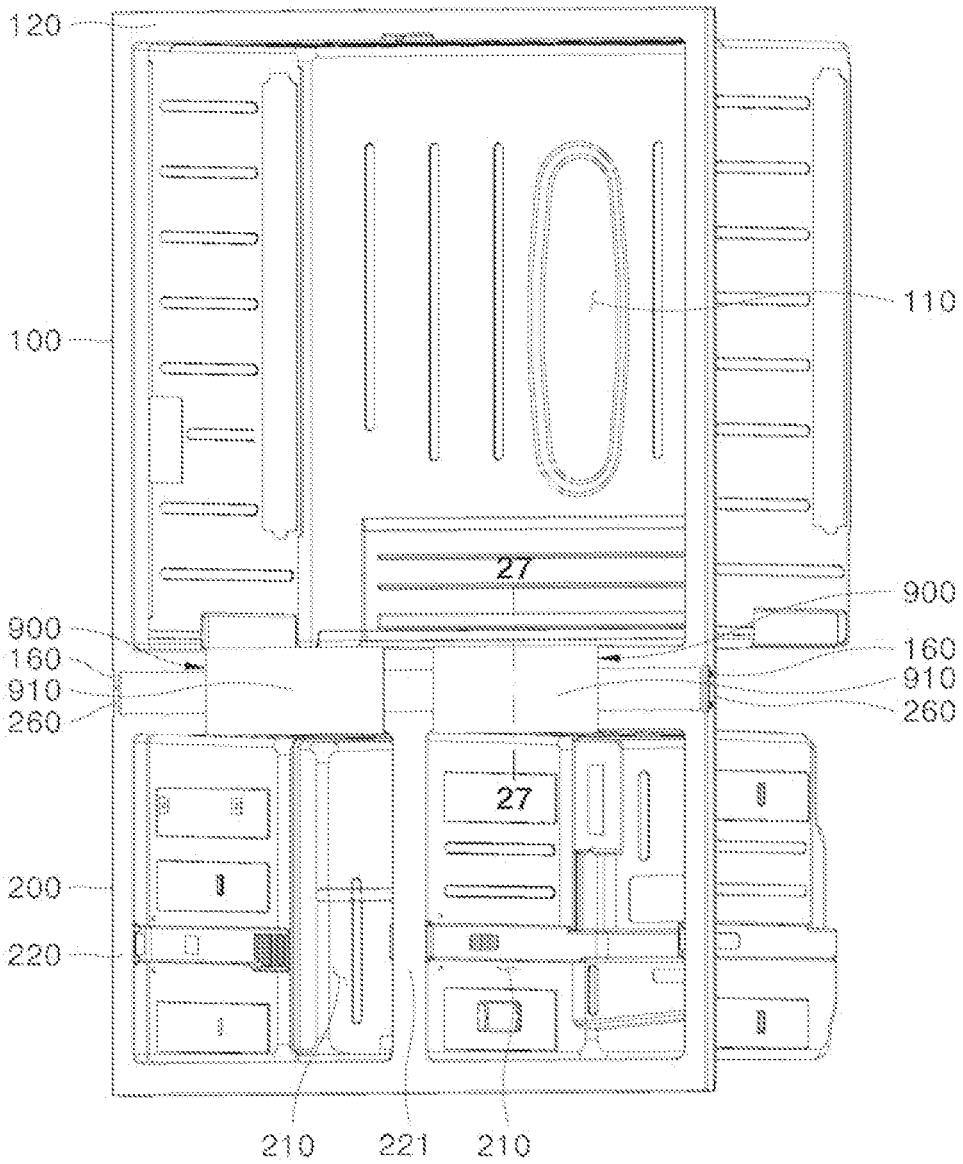
Figure 27:
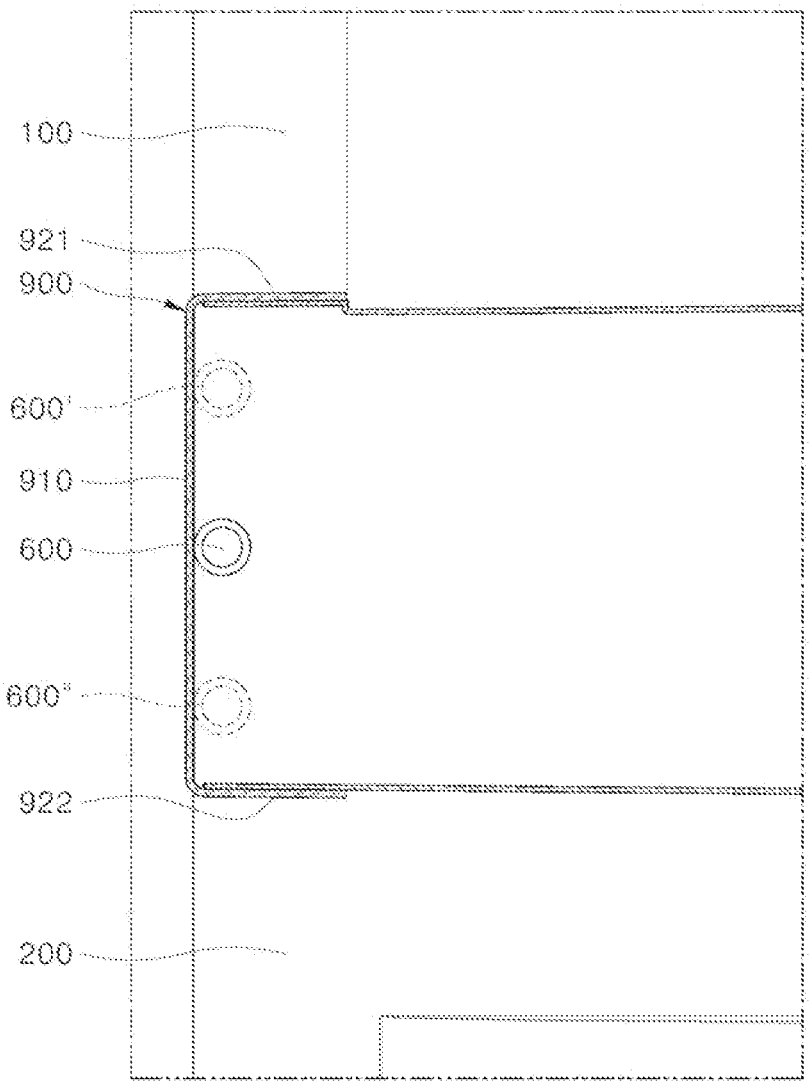

For example, as illustrated in FIG. 26, the plurality of coupling members 900 coupled from the front of the first inner case 100 and the second inner case 200 to the rear thereof may be spaced from each other, and respectively fastened to the first inner case 100 and the second inner case 200.

The plurality of coupling members 900 may be spaced from each other, with the division part 221 of the second inner case 200 therebetween.

The plurality of coupling members 900 is provided as described above to fasten the first inner case 100 and the second inner case 200, ensuring the simplification and ease of a coupling of inner cases having a different shape.

In another embodiment, the first inner case 100 and the second inner case 200 coupled and fixed by a coupling member 900 of yet another embodiment are described with reference to FIGS. 28 to 30.

Figure 28:
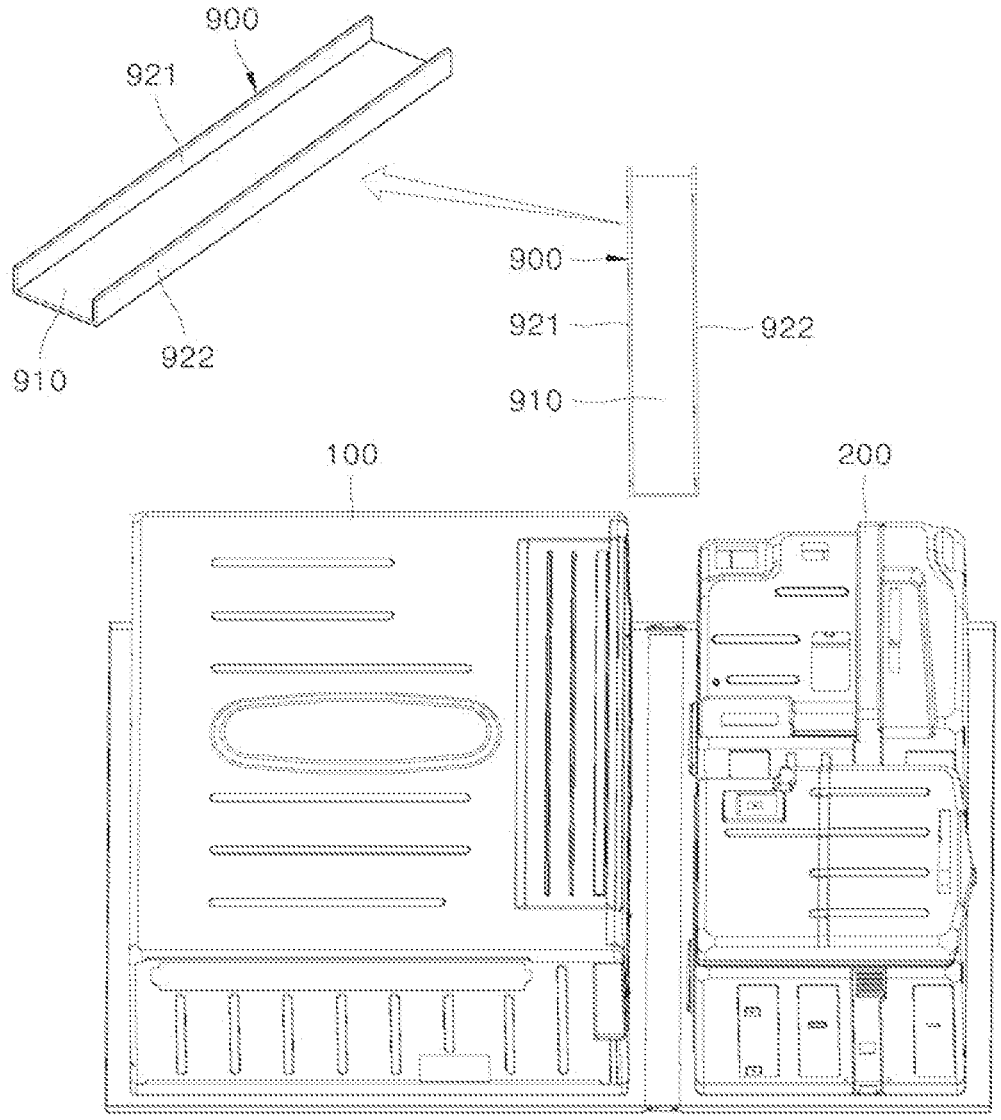
FIGS. 28 to 30 are views showing that a plurality of cases is coupled and fixed by a coupling member of yet another embodiment.
Figure 29:
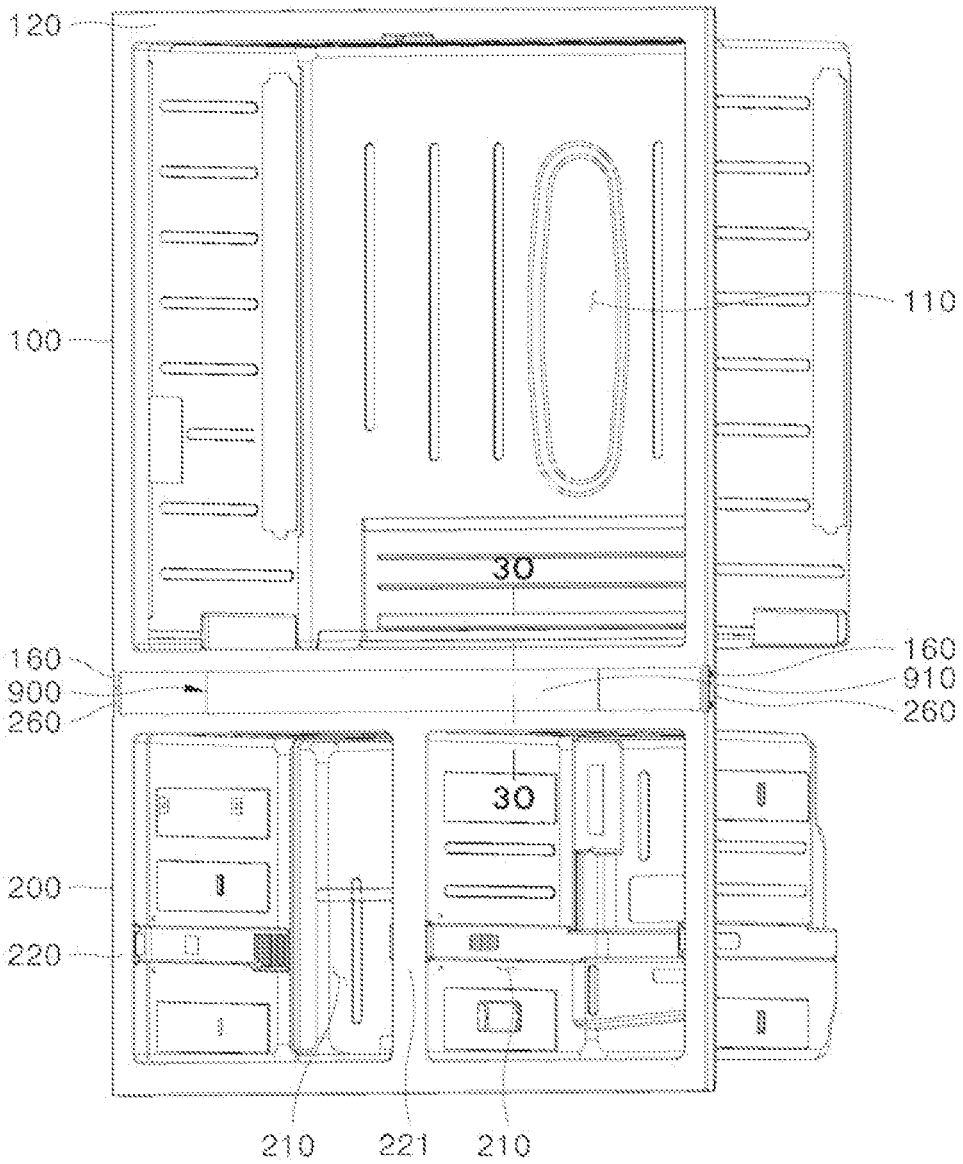
Figure 30:
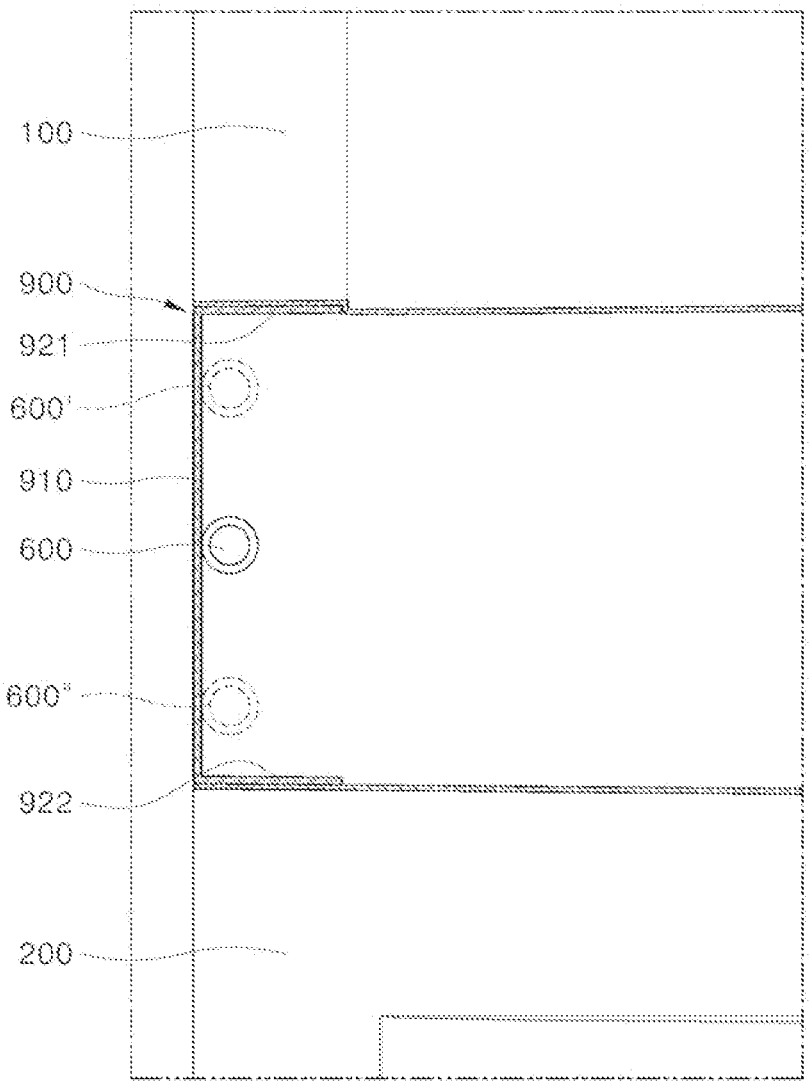

Referring to FIGS. 28 and 29, the coupling member 900 may be coupled to the first inner case 100 and the second inner case 200 from the rear of the first inner case 100 and the second inner case 200 to the front thereof.

Accordingly, the first fixation part 921 may be inserted into the outer side of the lower surface of the first inner case 100, and the second fixation part 922 may be inserted into the outer side of the upper surface of the second inner case 200.

The first fixation part 921 contacting the outer surface of the lower surface of the first inner case 100, and the second fixation part 922 contacting the outer surface of the upper surface of the second inner case 200 may be respectively fastened to the first inner case 100 and the second inner case 200.

Accordingly, the short side of the coupling member 900 in FIG. 28 may have a width less than that of the short side of the coupling member 900 in FIG. 22.

FIGS. 31 to 35 are views showing that a plurality of cases is coupled and fixed by a coupling member 900 of various embodiments.

FIGS. 31 to 35 are views showing that a plurality of cases having different shapes and sizes is coupled and fixed by a coupling member 900 of various embodiments.

A coupling member 900 described hereafter may have different shapes as the shapes of the coupling member 900 are illustrated in FIGS. 22, 25 and 28.

Additionally, the coupling member 900 may be coupled to the cases, based on a method in which the first fixation part 921 and the second fixation part 922 of the coupling member 900 are inserted into and fastened to the inside of each of the cases, as described in an example with reference to FIGS. 23 and 26, or based on a method in which the first fixation part 921 and the second fixation part 922 of the coupling member 900 are inserted into and fastened to the outside of each of the cases, as illustrated in an example with reference to FIG. 29.

Additionally, the case in the present disclosure may not be limited to a case that forms a storage compartment of a refrigerator, but may be applied to a variety of home appliances such as an air conditioner, a clothing care closet, a washing machine, a dishwasher and a cooking appliance comprising a plurality of cases that forms a storage compartment.

Figure 31:
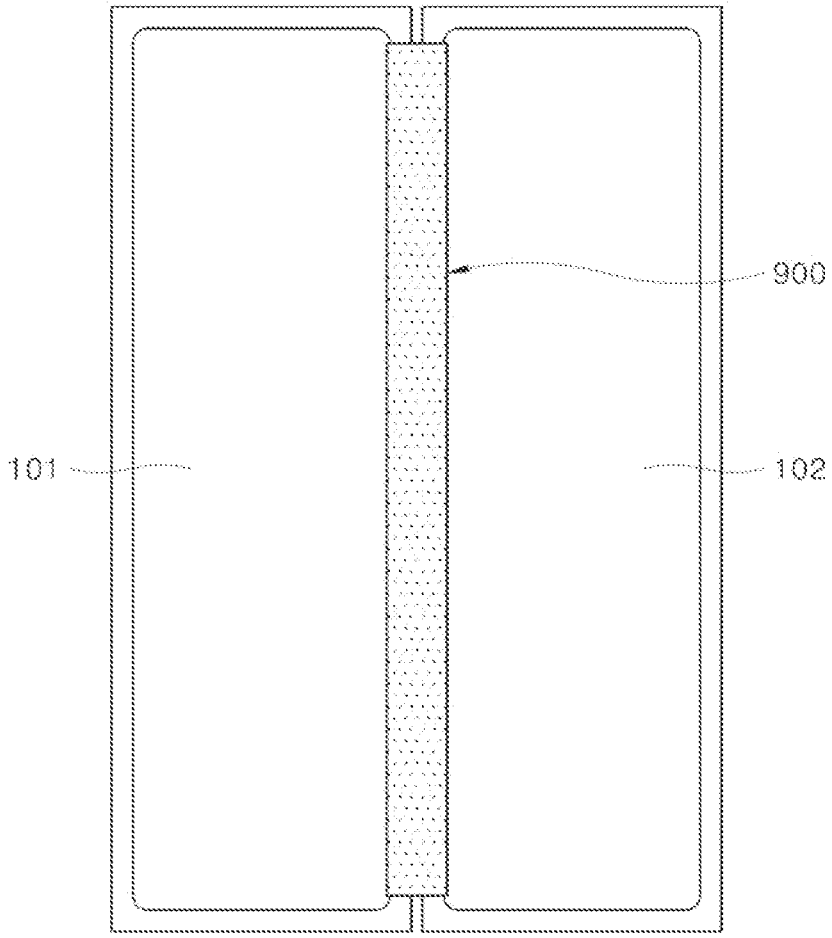
FIGS. 31 to 35 are views showing that a plurality of cases having different shapes and sizes is coupled and fixed by a coupling member of various embodiments.

Referring to FIG. 31, a first case 101 and a second case 102 may be disposed side by side in the left-right direction.

For example, the first case 101 and the second case 102 may be formed to extend in the up-down direction, and a coupling member 900 may be fastened to a surface where the first case 101 and the second case 102 face each other.

Figure 32:
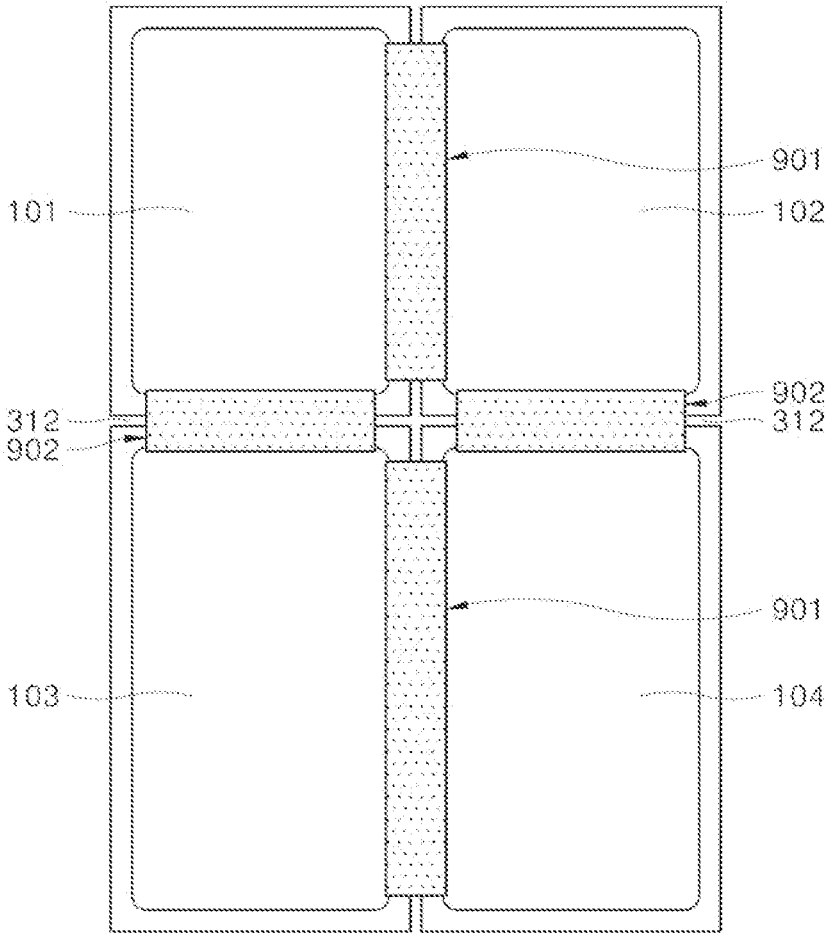

Referring to FIG. 32, four cases may be fastened by four coupling members.

For example, a second case 102 and a fourth case 104 disposed in the up-down direction may be disposed at one side of a first case 101 and a third case 103 disposed in the up-down direction.

At this time, the first case 101, the second case 102, the third case 103 and the fourth case 104 may have the same shape and size.

Each of the first case 101, the second case 102, the third case 103 and the fourth case 104 may be fastened by a first coupling member 901, and the first case 101 and the third case 103, and the second case 102 and the fourth case 104 may be respectively fastened by a second coupling member 902.

In the case of a second coupling member 902 disposed between the first case 101 and the third case 103, the second coupling member 902 may be disposed to provide a separation space where the hinge mounting part 312, at which the hinge of the door is disposed, is formed at one side between the first case 101 and the third case 103.

Accordingly, the second coupling member 902 may be disposed in a way that the second coupling member 902 is close to the direction of the inner side of the first case 101 and the third case 103.

The hinge mounting part 312, as described above, may also be formed between the second case 102 and the fourth case 104, and repetitive description in relation to this is omitted.

Figure 33:
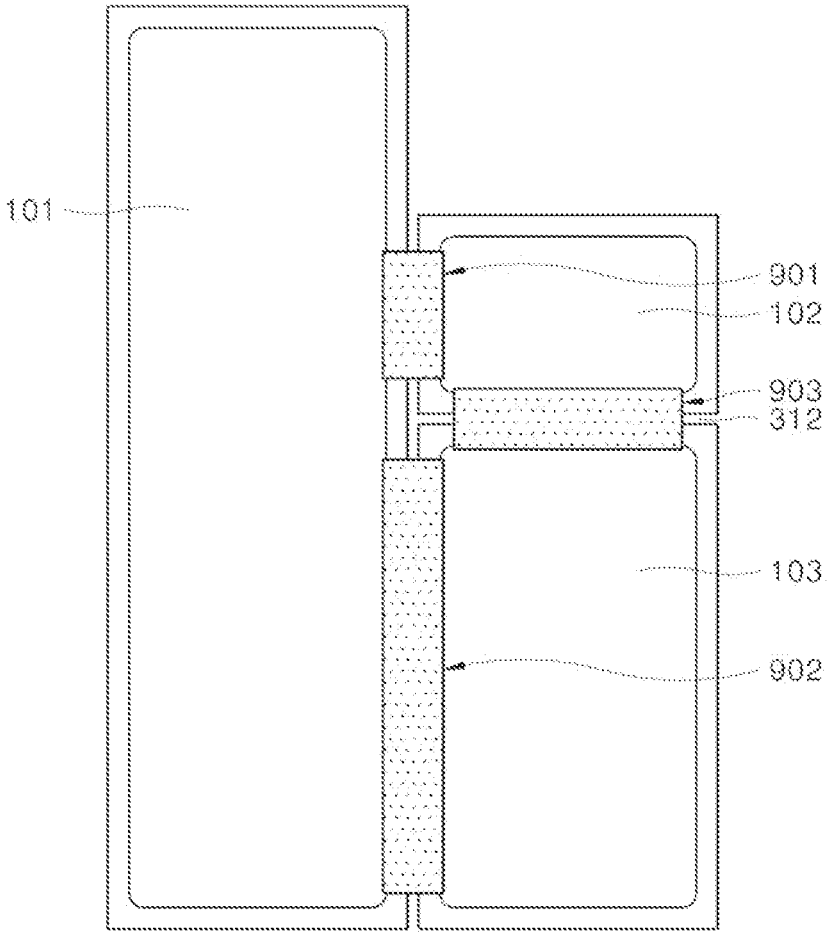

Referring to FIG. 33, three cases may be fastened by three coupling members.

For example, a second case 102 and a third case 103 having different heights may be stacked and disposed at one side of a first case 101.

The first case 101 and the second case 102 disposed as described above may be fastened by a first coupling member 901, and the second case 102 and the third case 103 may be fastened by a second coupling member 902, and the first case 101 and the third case 103 may be fastened by a third coupling member 903.

At this time, the shapes and sizes of the first coupling member 901, the second coupling member 902 and the third coupling member 903 may vary to correspond to the shapes and sizes of the first case 101, the second case 102 and the third case 103.

Figure 34:
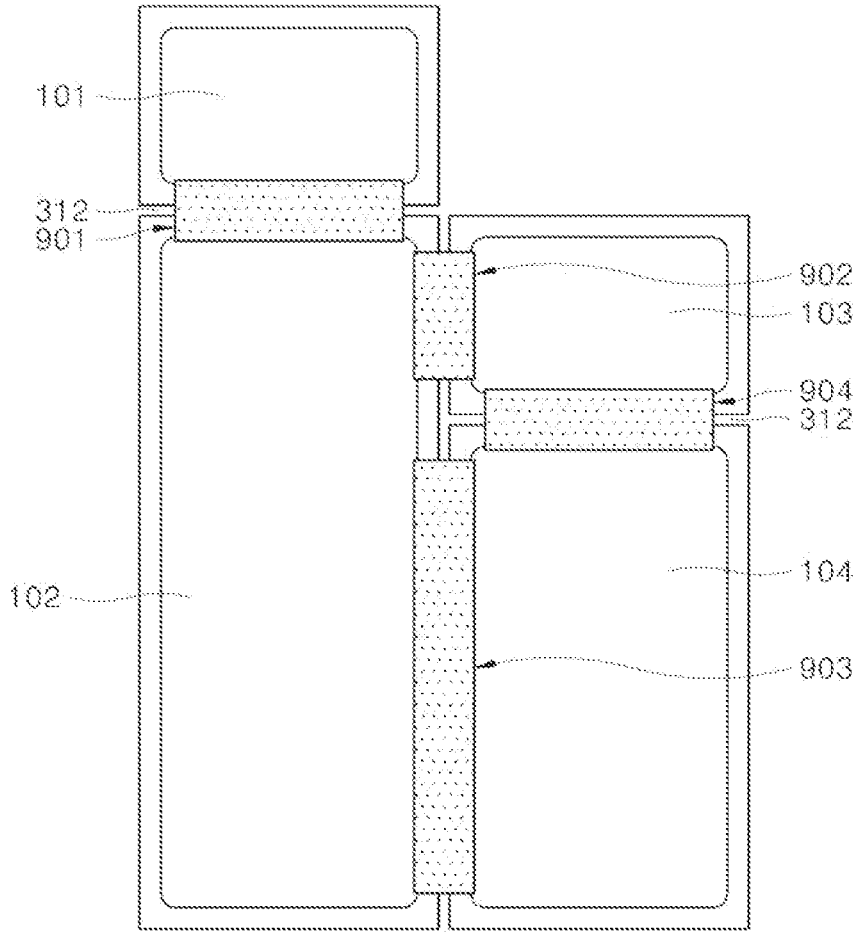

Referring to FIG. 34, four cases may be fastened by four coupling members.

For example, a third case 103 and a fourth case 104 having different heights may be stacked and disposed at one side of a first case 101 and a second case 102 that are stacked to have different heights.

At this time, the height of the first case 101 may be the same as the height at which the third case 103 and the fourth case 104 are stacked.

The first case 101 and the second case 102 disposed as described above may be fastened by a first coupling member 901, the second case 102 and the third case 103 may be fastened by a second coupling member 902, the second case 102 and the fourth case 104 may be fastened by a third coupling member 903, and the third case 103 and the fourth case 104 may be fastened by a fourth coupling member 904.

At this time, in the case of a first case 101 having a maximum height, the first case 101 may be fastened to the plurality of cases by the plurality of coupling members such as the second coupling member 902 and the third coupling member 903.

Figure 35:
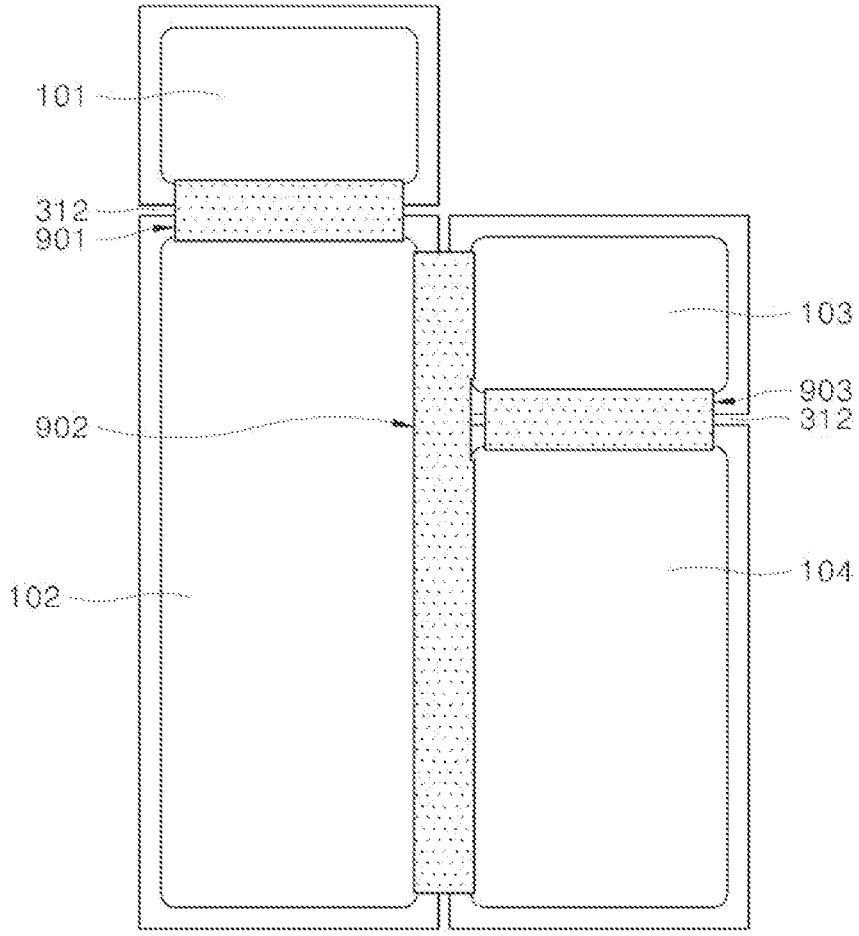

Referring to FIG. 35, four cases may be fastened by three coupling members.

For example, a third case 103 and a fourth case 104 having different heights may be stacked and disposed at one side of a first case 101 and a second case 102 that are stacked to have different heights.

At this time, the height of the first case 101 may be the same as the height at which the third case 103 and the fourth case 104 are stacked.

The first case 101 and the second case 102 disposed as described above may be fastened by a first coupling member 901, the second case 102 may be fastened to the third case 103 and the fourth case 104 by a second coupling member 902, and the third case 103 and the fourth case 104 may be fastened by a third coupling member 903.

At this time, in the case of a first case 101 having a maximum height, the first case 101 may be fastened to the plurality of cases by one fastening member such as the second coupling member 902.

At this time, for the second coupling member 902, a fixation part disposed at one side of the second coupling member 902 may comprise a groove part, as described with reference to FIG. 22.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

The invention claimed is:

1. A refrigerator comprising:

a first inner case having a first front surface defining a first portion of an exterior of a front surface of the refrigerator;

a second inner case having a second front surface defining a second portion of the exterior of the front surface of the refrigerator, the second inner case being separable from the first inner case; and a coupling assembly being disposed at a rear of each of the first front surface and the second front surface, the coupling assembly being fastened to rear surfaces of the first inner case and the second inner case by a fastening member, the coupling assembly being configured to fix the first inner case to the second inner case.

2. The refrigerator of claim 1, wherein a first hot line is disposed along the rear of the first front surface, and wherein a second hot line is disposed along the rear of the second front surface.

3. The refrigerator of claim 2, wherein the coupling assembly comprises a first coupling plate and a second coupling plate, the second coupling plate being separable from the first coupling plate, wherein the first hot line is disposed between the rear of the first front surface and the first coupling plate, and wherein the second hot line is disposed between the rear of the second front surface and the second coupling plate.

4. The refrigerator of claim 1, wherein each of the first inner case and the second inner case is formed as a one-piece member.

5. The refrigerator of claim 1, wherein the first inner case includes a first protrusion protruding in a first direction, wherein the second inner case includes a second protrusion protruding in a second direction to face the first protrusion, and wherein the coupling assembly is coupled to rear surfaces of the first protrusion and the second protrusion.

6. The refrigerator of claim 5, wherein the first protrusion extends along a left-right direction of the first front surface and protrudes from a lower portion of the first front surface, and wherein the second protrusion extends along a left-right direction of the second front surface and protrudes from an upper portion of the second front surface.

7. The refrigerator of claim 5, wherein the coupling assembly comprises:

a first coupling plate coupled to the rear surface of the first protrusion; and a second coupling plate coupled to the rear surface of the second protrusion, the first coupling plate and the second coupling plate being coupled to each other.

8. The refrigerator of claim 7, wherein the first coupling plate includes a first combination surface facing the second coupling plate, wherein the second coupling plate includes a second combination surface facing the first coupling plate, and wherein a gasket foam is disposed between the first combination surface and the second combination surface.

9. The refrigerator of claim 7, further comprising:

a pair of first doors to open and close the first inner case; and a pair of hinges rotatably supporting the pair of first doors, wherein the first coupling plate includes a pair of hinge mounting parts to receive the pair of hinges therein.

10. The refrigerator of claim 9, further comprising a pair of hinge covers to cover the pair of hinge mounting parts, the pair of hinge covers being disposed on front surfaces of the hinge mounting parts, and wherein the pair of hinge covers define third portions of the exterior of the front surface of the refrigerator.

11. The refrigerator of claim 7, further comprising a back plate coupled to rear surfaces of the first coupling plate and the second coupling plate to connect the first coupling plate to the second coupling plate.

12. The refrigerator of claim 11, wherein the back plate comprises:

a body part;

a first extension part extending from a first side of the body part, the first extension part being inclined outward and downward; and a second extension part extending from a second side of the body part, the second extension part being inclined outward and upward, wherein the first coupling plate includes a first reinforcement rib with a first inclination part that has a shape corresponding to a shape of the first extension part, wherein the second coupling plate has a second reinforcement rib with a second inclination part that has a shape corresponding to a shape of the second extension part, and wherein, when the back plate is coupled to the first coupling plate and the second coupling plate, the first extension part and the second extension part press the first inclination part and the second inclination part, respectively.

13. The refrigerator of claim 12, wherein the body part includes a plurality of fastening holes, wherein each of the first coupling plate and the second coupling plate includes a plurality of first rear surface fastening parts and a plurality of second rear surface fastening parts that correspond to the plurality of fastening holes, and wherein each of the fastening holes is fastened to a corresponding one of the first rear surface fastening parts or the second rear surface fastening parts by the fastening member such that the body part presses the first rear surface fastening parts and the second rear surface fastening parts.

14. The refrigerator of claim 5, wherein a deco plate is disposed on front surfaces of the first protrusion and the second protrusion, the deco plate being coupled to the first protrusion and the second protrusion to cover the first protrusion and the second protrusion.

15. The refrigerator of claim 14, wherein the deco plate defines a fourth portion of the exterior of the front surface of the refrigerator.

16. A refrigerator comprising:

a first inner case;

a second inner case, the second inner case being separable from the first inner case; and a coupling assembly disposed at a front part of each of the first inner case and the second inner case, the coupling assembly being fastened to rear surfaces of the first inner case and the second inner case by a fastening member to fix the first inner case to the second inner case.

17. The refrigerator of claim 16, wherein the first inner case includes a first protrusion protruding downward from a front of the first inner case, wherein the second inner case includes a second protrusion protruding upward from a front of the second inner case, and wherein the coupling assembly is coupled to rear surfaces of the first protrusion and the second protrusion.

18. A manufacturing method of a refrigerator comprising:

forming a first inner case that includes a first protrusion protruding downward from a front of the first inner case;

forming a second inner case that includes a second protrusion protruding upward from a front of the second inner case;

coupling a first coupling plate to a rear surface of the first protrusion;

coupling a second coupling plate to a rear surface of the second protrusion;

disposing the first inner case and the second inner case such that the first coupling plate and the second coupling plate face each other; and coupling a back plate to rear surfaces of the first coupling plate and the second coupling plate.

19. The manufacturing method of claim 18, further comprising:

disposing a first hot line along a rear surface of the first inner case before coupling the first coupling plate to the rear surface of the first protrusion; and disposing a second hot line along a rear surface of the second inner case before coupling the second coupling plate to the rear surface of the second protrusion.

20. The manufacturing method of claim 18, further comprising:

placing the first inner case and the second inner case into an outer case;

injecting a foaming liquid between the outer case and the first and second inner cases; and coupling a deco plate to front surfaces of the first protrusion and the second protrusion.

* * * * *